US007466837B2

(12) United States Patent
Nakamura

(10) Patent No.: US 7,466,837 B2
(45) Date of Patent: Dec. 16, 2008

(54) DIFFUSER AND SPEAKER USING THE SAME

(75) Inventor: Takeshi Nakamura, Uji (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/567,830

(22) PCT Filed: Jul. 27, 2004

(86) PCT No.: PCT/JP2004/010640

§ 371 (c)(1),
(2), (4) Date: Sep. 26, 2006

(87) PCT Pub. No.: WO2005/015947

PCT Pub. Date: Feb. 17, 2005

(65) Prior Publication Data

US 2007/0064958 A1 Mar. 22, 2007

(30) Foreign Application Priority Data

| | | |
|---|---|---|
| Aug. 12, 2003 | (JP) | 2003-292069 |
| Oct. 23, 2003 | (JP) | 2003-362915 |
| Jun. 7, 2004 | (JP) | 2004-168954 |
| Jul. 9, 2004 | (JP) | 2004-203933 |

(51) Int. Cl.
*H04R 25/00* (2006.01)

(52) U.S. Cl. ..... 381/337; 381/160; 381/338; 381/339; 381/340; 381/347; 381/350

(58) Field of Classification Search ..... 381/335, 381/336, 152, 337, 338, 339, 340, 341, 342, 381/343, 347, 350, 352, 160; 181/191
See application file for complete search history.

(56) References Cited

U.S. PATENT DOCUMENTS

| | | | | |
|---|---|---|---|---|
| 4,322,578 | A * | 3/1982 | Selmin | 381/160 |
| 4,870,691 | A * | 9/1989 | Mindel | 381/350 |
| 5,832,099 | A * | 11/1998 | Wiener | 381/386 |
| 6,064,744 | A * | 5/2000 | Augustin | 381/160 |

(Continued)

FOREIGN PATENT DOCUMENTS

JP 51-131226 U 4/1950

(Continued)

OTHER PUBLICATIONS

Electric & Electronic Engineering Encyclopedia vol. 25 "Audio Video", supervising editor Shigeo Tsuji, Published Nov. 1983 from Denkishoin.

(Continued)

*Primary Examiner*—Wayne R Young
*Assistant Examiner*—Dionne H Pendleton
(74) *Attorney, Agent, or Firm*—Dickstein Shapiro LLP

(57) ABSTRACT

A spherical wave generating diffuser positioned in front of the sound emission side of a sound source. The diffuser comprises an inner horn and an outer horn positioned concentrically around the inner horn. The diffuser generates pseudo-spherical waves centered on the inner horn because the emission speed of the sound waves emitted from between the outer horn and the inner horn are slower than the emission speed of sound waves emitted from within the inner horn.

14 Claims, 14 Drawing Sheets

U.S. PATENT DOCUMENTS

| | | | | |
|---|---|---|---|---|
| 6,389,144 | B1 * | 5/2002 | Lee | 381/340 |
| 2004/0020711 | A1 * | 2/2004 | China | 181/176 |

FOREIGN PATENT DOCUMENTS

| | | | |
|---|---|---|---|
| JP | 52-147021 | U | 4/1951 |
| JP | 58-3689 | U | 6/1956 |
| JP | 50-42838 | | 4/1975 |
| JP | 59-81184 | | 6/1984 |
| JP | 60-167494 | | 11/1985 |
| JP | 62-173896 | U | 11/1987 |
| JP | 11-196485 | | 7/1999 |

OTHER PUBLICATIONS

Written Opinion of the International Searching Authority dated Sep. 14, 2004.
International Search Report dated Sep. 14, 2004.

* cited by examiner

DIFFUSER AND SPEAKER USING THE SAME

FIELD OF THE INVENTION

The present invention relates to a diffuser and to a speaker using the same, and more particularly relates to a diffuser for generating pseudo-spherical wave sound waves, and to a speaker for generating spherical waves using the diffuser.

BACKGROUND OF THE INVENTION

In general, speakers used in the field of pure-audio and the like are demanded to yield full and rich tone, while ensuring sufficient volume.

Conventional speakers which have been proposed include cone speakers wherein a diaphragm is formed in a conical shape, so-called dome speakers wherein a diaphragm is formed in a half-sphere shape and the convex side thereof is used as the sound generating portion, and so forth (see Electric & Electronic Engineering Encyclopedia Vol. 25 "Audio Video", supervising editor Shigeo Tsuji, Published November 1983 from Denkishoin, and also Japanese Unexamined Patent Application Publication No. 11-196485).

With a conventional cone speaker, a cone-shaped diaphragm generates sound waves by back-and-forth piston movement, so a great volume can be readily obtained, but the diaphragm simply performs piston motions back and forth, so the emission wavefront of the sound wave is generally a planar wave. That is to say, this is not a spherical wave as with dome speakers mentioned above, so air disturbance (vortex) occurs due to a difference in air pressure at the boundary between a vibration region and a non-vibration region, disturbing sound waves and rendering it difficult to obtain a full and rich tone. The vibration region as used herein means a generally pillar-shaped region of which the base face is the diaphragm, and the air is directly vibrated by vibrations of the diaphragm.

On the other hand, the latter dome speaker generates sound waves by breathing actions wherein the diaphragm stretches and shrinks, so the sound waves are naturally spherical waves. Such spherical waves are advantageous in yielding full and rich tone as described above, without air disturbance (vortex).

However, such dome speakers have a structure wherein only the perimeter portion of the half-sphere diaphragm is securely held, rather than a structure such as with the cone speaker wherein the entire diaphragm moves, and moreover, sound waves are generated by breathing actions, so great amplitude cannot be expected. Accordingly, great volume, and base sounds which require great vibrations, are difficult to obtain.

Non-Patent Document 1: Electric & Electronic Engineering Encyclopedia Vol. 25 "Audio Video", supervising editor Shigeo Tsuji, Published November 1983 from Denkishoin Patent Document 1: Japanese Unexamined Patent Application Publication No. 11-196485

SUMMARY OF THE INVENTION

The present invention provides for a diffuser for generating spherical waves wherein air disturbance (vortex) occurring due to difference in air pressure between vibration region and non-vibration region is suppressed so as to yield a full and rich tone, while ensuring sufficiently great volume, and a speaker for generating spherical waves using the same.

In order to achieve the above object, a diffuser of the invention is placed in front of a sound wave emission side of a sound source, the diffuser having a tapered opening space formed along a sound wave emission direction from the sound source at a region including a generally center portion facing the sound wave emission face, and wherein an outer tapered opening space formed on the outer side thereof.

The diffuser according to the present invention has a configuration wherein the region including the generally center portion facing the sound wave emission face of the sound source forms a tapered opening space configuration along the sound wave emission direction from the sound source, so pseudo-spherical wave sound waves are emitted overall, primarily at the tapered opening space configuration. A sound source having a face for emitting sound waves by piston vibrations is optimal.

In another embodiment, in front of the tapered opening end of the tapered opening space configuration is formed another tapered opening space configuration including the generally center portion of the tapered opening end facing the sound source along the sound wave emission direction from this tapered opening end, with an outer tapered opening space formed on the outer side thereof.

When the diffuser of the present invention is placed in front of a sound wave emission side of a sound source, a region with a fast sound wave emission speed is formed along a sound wave emission direction from the sound source at a region including a generally center portion facing the sound wave emission face, and a region with a slow sound wave emission speed is formed on the outer side thereof, so pseudo-spherical wave sound waves are emitted overall.

The sound wave emission speed as used herein means the speed of the airflow, pushed out (suctioned) by the diaphragm, at the opening.

In a further embodiment, the diffuser of the present invention includes another region with a fast sound wave emission speed along a sound wave emission direction from the tapered opening end at a region including a generally center portion of the tapered opening end facing the sound source, and another region with a slow sound wave emission speed formed on the outer side thereof.

Preferably, the diffuser of the present invention includes a conical center flow plate having a tapered shape with both ends opened, disposed along the sound wave emission direction.

The diffuser of the present invention also preferably includes a conical outer flow plate having an outwardly tapered shape with both ends opened, disposed along the sound wave emission direction on the outer side of the conical center flow plate.

In yet a further embodiment, the diffuser of the present invention comprises a plurality of center flow plates provided along the sound wave emission direction in parallel with each other, with a predetermined spacing therebetween, and inclined at a predetermined angle so as to be tapered as to the sound wave emission direction.

Preferably, the diffuser of this embodiment, further comprises, on the outer side of the center flow plates, a plurality of outer flow plates provided along the sound wave emission direction in parallel with each other, with a predetermined spacing therebetween, and inclined at a predetermined angle so as to be tapered outwardly relative to the sound wave emission direction.

With this embodiment of the present invention, a diffuser with a simple configuration can be easily obtained by disposing a plurality of flow plates at predetermined spacing and angles.

The speaker of the invention includes a diffuser according to the present invention disposed in front of a sound wave emission side of a sound source having a face which emits sound waves by piston vibrations.

Assembling the diffuser into a normal speaker or the like serving as a sound source forms a speaker which generates pseudo-spherical wave sound waves extremely easily. In addition to a sufficiently greater volume than using a dome speaker of the same size, there is little air disturbance (vortex), so sound can be transmitted naturally, and a full and rich tone can be obtained. Also, all that is necessary for the sound source is a single speaker, rather than a configuration for generating pseudo-spherical wave sound waves using a combination of multiple speakers, so the price is inexpensive, and the size can be reduced.

The speaker of the present invention preferably has a protective net disposed in front of the sound wave emission side of the sound source, and the diffuser is fixed to the protective net.

In addition, the spherical wave generating speaker of the present invention does not require attachment to a speaker frame or housing and accordingly does not damage these components, and further can be configured without restrictions in the shape of the speaker diaphragm, edge, frame, cabinet, etc., thereby enabling application to a wide range of speaker designs. That is to say, there are no restrictions regarding attaching of the diffuser since this can be performed by simply attaching and detaching the protective net. Also, since the diffuser can be attached and detached by attaching and detaching the protective net, the effects of the diffuser can be easily confirmed, transplanting to other speakers can be easily performed, standardization for a wide range of speakers can be made, and reduction in size and further reduction in price can be realized.

The diffuser can also be fixed in front of the protective net, and the diffuser can be attached even without removing the protective net, meaning that the diffuser can be mounted to an existing speaker with no alterations.

The diffuser can also be fixed behind the protective net so that the protrusion of the diffuser can be reduced, giving the front of the speaker a trim look, and also the diffuser can be protected by the protective net. The diffuser can also be fixed both in front of and behind the protective net. Accordingly, the diffuser can be mounted to an existing speaker with no change, reduction in size can be realized, and also a full and rich tone can be easily realized.

The diffuser can be fixed to the protective net by an adhesive member, or by a connecting member. Accordingly, mounting to an already-existing speaker can be easily performed.

As used herein, the term horn means the space defined by a flow plate disposed following the direction of a sound wave emission with both ends opened. Inner horn means the space defined by a tapered center flow plate disposed following the direction of the sound wave emission with both ends opened, and outer horn means the outwardly tapered space with both ends opened defined on the outer side of the center flow plate.

With the diffuser according to the present invention, a tapered opening space configuration is formed along a sound wave emission direction from the sound source at a region including a generally center portion facing the sound source, so pseudo-spherical wave sound waves are emitted overall, primarily at the tapered opening space configuration. Accordingly, attaching this diffuser to a sound source such as a cone type dynamic speaker enables sufficiently greater volume than using a dome speaker of the same size. Also, there is little air disturbance (vortex), so sound can be transmitted naturally, and a full and rich tone can be obtained.

Assembling the diffuser into a normal speaker or the like serving as a sound source forms a speaker which generates pseudo-spherical wave sound waves extremely easily. With the speaker according to the present invention, in addition to a sufficiently greater volume than using a dome speaker of the same size, there is little air disturbance (vortex), so sound can be transmitted naturally, and a full and rich tone can be obtained. Also, all that is necessary for the sound source is a single speaker, rather than a configuration for generating pseudo-spherical wave sound waves using a combination of multiple speakers, so the price is inexpensive, and the size can be reduced.

REFERENCE NUMERALS

Figure 1:
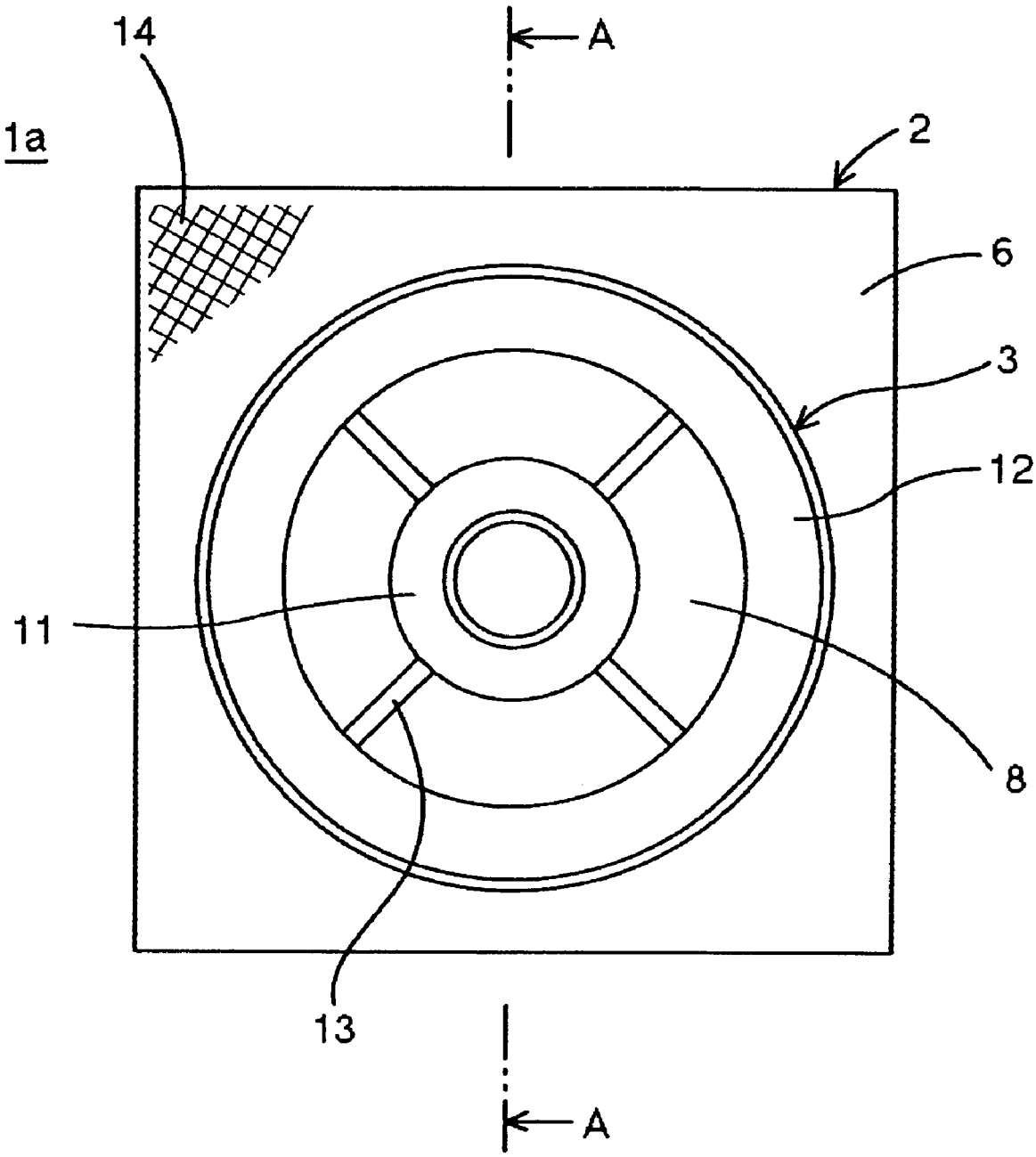
FIG. 1 is a front view illustrating a first embodiment of a speaker using the diffuser according to the present invention.

1*a*, 1*b*, 1*c*, 1*d*, 1*e*, 1*f*, 1*g*, 1*h*, 1*i*, 1*j*, 1*k*, 1*l*, 1*n*, 1*o* spherical wave speaker
2, 2*c* cone type dynamic speaker
2*a* dome type dynamic speaker
3, 3*b*, 3*c*, 3*d*, 3*e* spherical wave generating diffuser
6*a* opening
8, 8*a* diaphragm
11, 12, 21, 22 flow plate
14 protective net
15 inner horn
16 outer horn
17 adhesive agent
18, 19 connecting member

DETAILED DESCRIPTION OF THE INVENTION

With the diffuser according to the present invention, a tapered opening space configuration is formed along a sound wave emission direction from the sound source at a region including a generally center portion facing the sound source, so pseudo-spherical wave sound waves are emitted overall, primarily at the tapered opening space configuration. Accordingly, a speaker which yields full and rich tone, which is inexpensive, and which can be reduced in size, is realized.

First Embodiment

Figure 2:
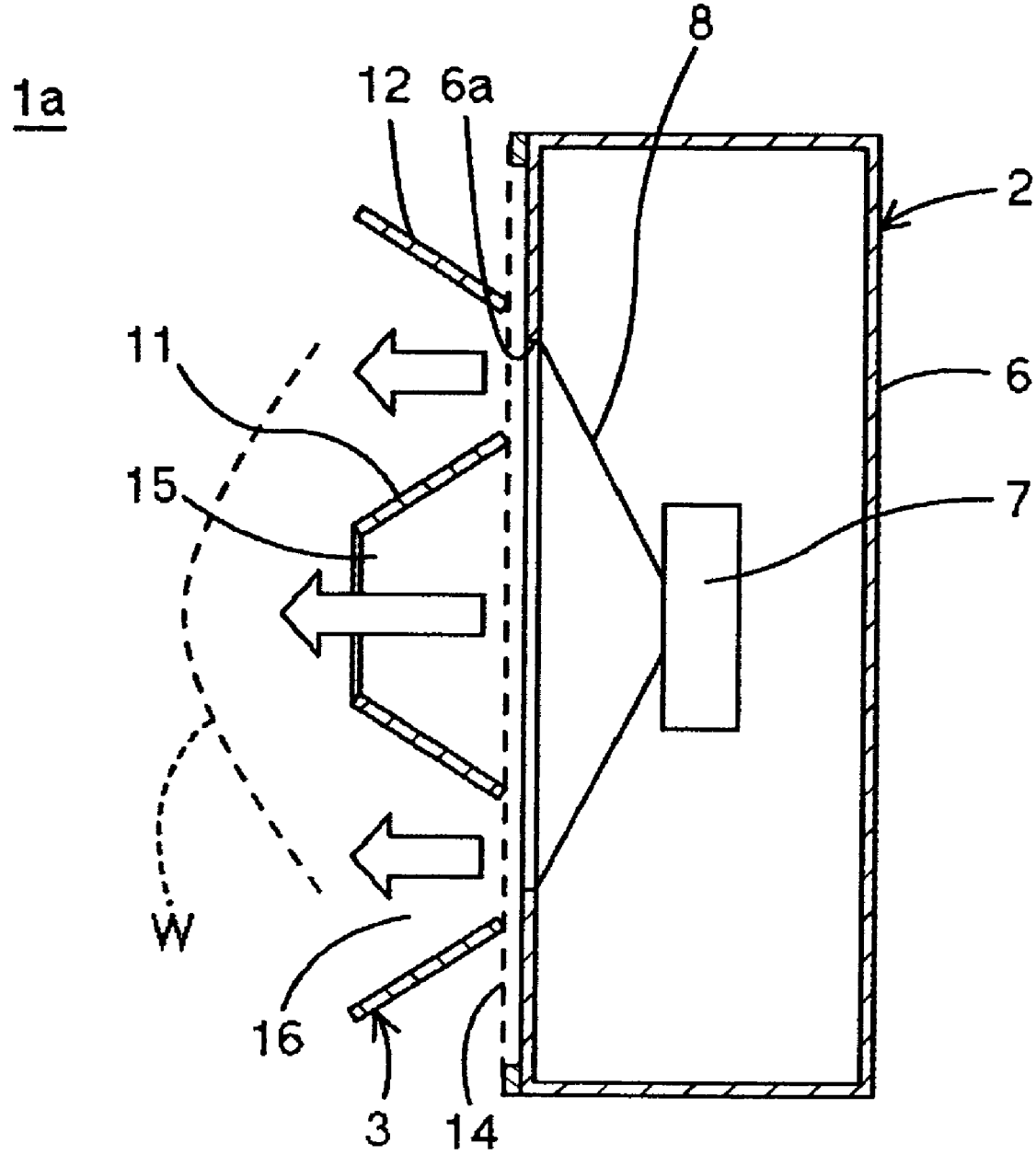
FIG. 2 is a cross-sectional view along line A-A in FIG. 1.

FIG. 1 is a frontal view illustrating a first embodiment of a speaker which generates spherical waves (hereafter referred to as "spherical generating speaker") using the diffuser according to the present invention, and FIG. 2 is a cross-sectional view along line A-A in FIG. 1.

A speaker 1*a* which uses the diffuser according to the present embodiment for generating spherical waves (hereafter referred to as "spherical generating speaker") comprises a singular cone type dynamic speaker 2 and a diffuser 3 for generating spherical waves (hereafter referred to as "spherical generating diffuser").

The cone type dynamic speaker 2 has a driver 7 including a voice coil and the like provided within a speaker box 6, and also a diaphragm 8 formed in a conical shape attached to the driver 7, with the diaphragm 8 being disposed facing an opening 6*a* formed in front of the speaker box 6. This cone type dynamic speaker 2 emits sound waves by the diaphragm 8 being vibrated in a frequency range of a piston vibration range. Accordingly, in this case, the diaphragm 8 is the sound source. The term piston vibration range refers to a relatively low-frequency range in which the diaphragm 8 vibrates back and forth as a whole, rather than locally, to generate sound waves. More specifically, frequencies lower than a frequency value (unit [l/s]) obtained by dividing the speed of sound (340 [m/s] at normal temperature) by the circumference of the diaphragm 8 ($2\pi r$[m] if circular) is the piston vibration range.

A sound source is "a boundary face where waves (planar waves) of air particles with matching compression wave phases in the direction of travel of sound waves are emitted into open space". Accordingly, with the case of a cone type dynamic speaker as described above, the diaphragm 8 is the sound source.

On the other hand, the spherical wave generating diffuser 3 has a center flow plate 11 and an outer flow plate 12 disposed around the center flow plate 11 concentrically therewith. The center flow plate 11 is formed conically in a tapered manner with both ends opened following the direction of sound wave emission such that the opening area of the sound wave output side is smaller than the opening area of the sound wave input side. Also, the outer flow plate 12 is formed conically in an outwardly tapered manner with both ends opened following the direction of sound wave emission such that the opening area of the sound wave output side is greater than the opening area of the sound wave input side. The center flow plate 11 and the outer flow plate 12 are disposed on the outer side of a protective net 14. Now, the tapered spatial structure having a conical shape with both ends opened that is formed on the inner side of the center flow plate 11 will be called an inner horn 15, and the outwardly tapered structure having a conical shape with both ends opened that is formed between the outer side of the center flow plate 11 and the outer flow plate 12 will be called an outer horn 16. The sound waves generated at the outer flow plate 12 are sound waves emitted from between the center flow plate 11 and the outer flow plate 12.

Moreover, in this case, if we define the flow speed of air at the opening portion due to the vibration of the cone type dynamic speaker 2 as the sound wave emission speed, the emission speed of sound waves generated at the inner horn 15 is speeded up by adjusting the ratio of the opening area at the input side of sound waves and the opening area at the output side so as to be approximately twice the emission speed of the sound waves generated at the outer horn 16.

The center flow plate 11 and outer flow plate 12 of this spherical wave generating diffuser 3 are integrally linked by four slender supporting rods 13 at the front side of the diaphragm 8 which is the sound source of the cone type dynamic speaker 2 in a concentric manner with the diaphragm 8 and with a slight gap therebetween so as to not come into contact therewith, and positioned and fixed to the speaker box 6 by an unshown bracket or the like.

The protective net 14 is provided at the gap in front of the speaker box 6 so as to not come into contact with the speaker diaphragm 8 or edge, so as to protect the speaker diaphragm 8 and edge from dust and foreign matter. The protective net 14 is formed of a thin, air-permeable, and flexible material, and in many cases is fabricated so as to be detachable.

With the spherical wave speaker 1*a* of the above-described configuration, upon the diaphragm 8 being vibrated within the piston movement frequency range by the driver 7 of the cone type dynamic speaker, sound waves are emitted toward the spherical wave generating diffuser 3.

Now, the inner horn 15 of the spherical wave generating diffuser 3 is formed in a tapered conical shape with both ends opened, so the opening area of the sound wave output side is smaller than the opening area of the sound wave input side, and accordingly, the sound wave emission speed increases. On the other hand, the outer horn 16 is formed in an outwardly tapering conical shape with both ends opened, along the direction of sound wave emission, so the opening area of the sound wave output side is greater than the opening area of the sound wave input side, and accordingly, the sound wave emission speed decreases. Consequently, the emission speed of sound waves emitted from the inner horn 15 is generally twice the emission speed of sound waves emitted from the outer horn 16. As a result, the overall emitted wave face of the spherical wave speaker 1*a* is a pseudo-spherical wave W centered on the inner horn 15, as indicated by the second broken line.

Thus, the spherical wave speaker 1*a* according to this first embodiment uses a cone type dynamic speaker 2 as the sound source thereof, so sufficiently greater amplitude can be obtained as compared with using a dome speaker of the same size, and accordingly, large volume can be obtained. Also, sound waves which have passed through the spherical wave generating diffuser 3 have an emission wavefront W which is close to a spherical wave. Using the cone type dynamic speaker 2 alone creates an air disturbance (vortex) due to the difference in air pressure between a vibration region and a non-vibration region. However, passing through the spherical wave generating diffuser 3 suppresses such an air disturbance (vortex) and sound waves can be transmitted without disturbance, so a full and rich tone can be obtained. Also, the sound source is not scattered so the auditory lateralization is stable, and a wide listening position can be obtained.

Further, using the spherical wave generating diffuser 3 allows a spherical wave speaker 1*a* to be easily realized using an already-existing speaker 2, which can lead to broader applications and also reduction in price.

Second Embodiment

Figure 3:
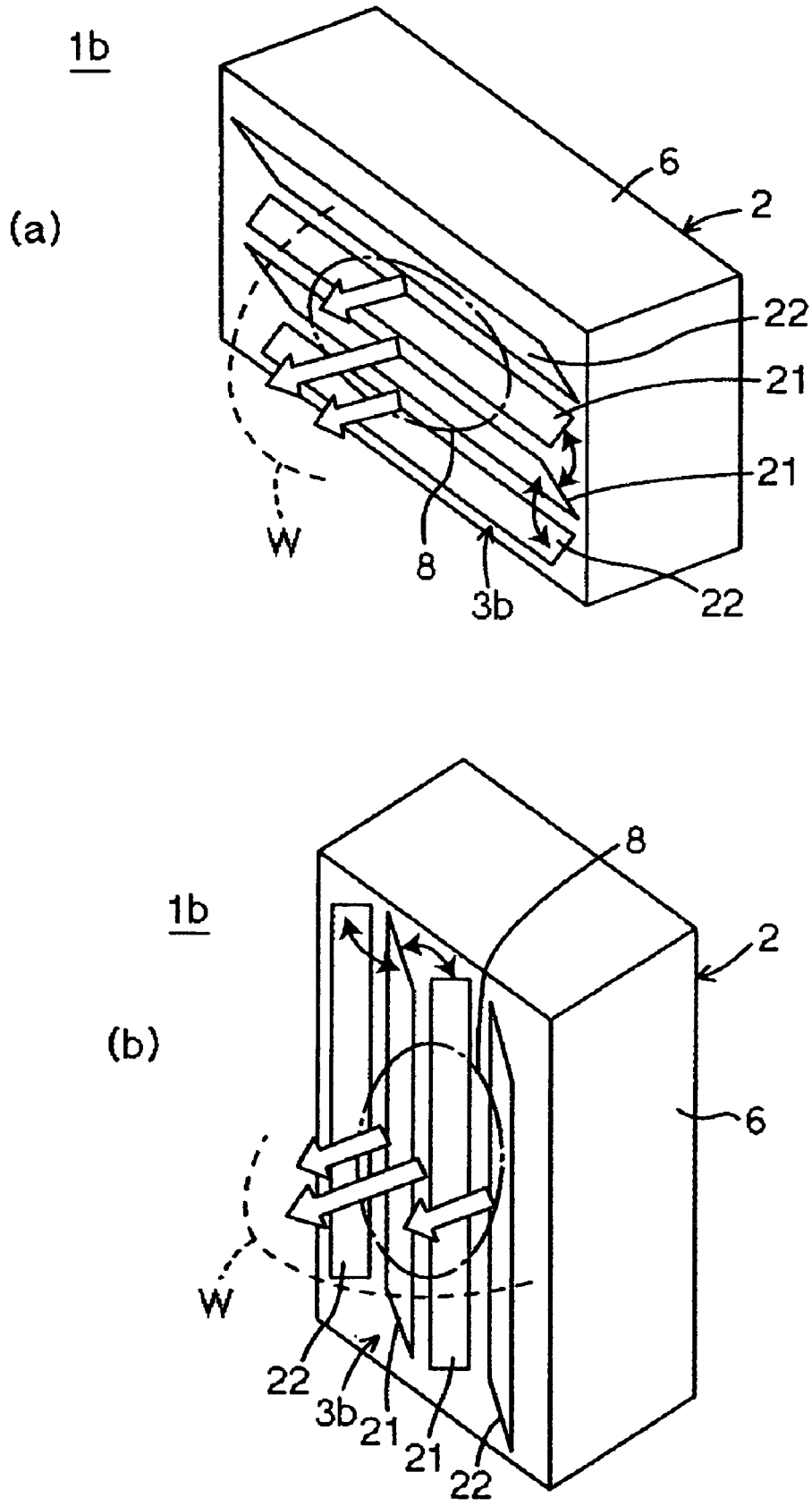
FIG. 3 is a perspective view illustrating a second embodiment of a speaker using the diffuser according to the present invention.

FIG. 3 is a perspective view illustrating a second embodiment of a spherical wave speaker using the spherical wave generating diffuser according to the present invention, with (a) in the drawing illustrating the state of the spherical wave speaker being placed horizontally, and (b) in the drawing illustrating the state of the spherical wave speaker being placed vertically.

The spherical wave speaker 1*b* according to this second embodiment is configured of a singular cone type dynamic speaker 2 and a spherical wave generating diffuser 3*b*.

The cone type dynamic speaker 2 is arranged so as to emit sound waves by the diaphragm 8 being vibrated in a frequency range of a piston vibration range, and is configured basically the same as the above-described first embodiment, so the detailed description thereof will be omitted here.

The spherical wave generating diffuser 3*b* according to the second embodiment has multiple (four in the present embodiment) flow plates 21 and 22 provided in parallel with each other with a predetermined spacing therebetween, and inclined at a predetermined angle along the sound wave emission direction (indicated by arrows in the drawing). That is to say, one pair of flow plates 21 positioned at the generally center portion of the diaphragm 8 of the cone type dynamic speaker 2 are disposed in an inclined manner so as to be tapered inwardly in the direction of sound wave emission, and the two flow plates 22 on the outer side adjacent thereto are disposed in an inclined manner relative to the adjacent inner flow plates 21 so as to be tapered outwardly in the direction of sound wave emission.

Moreover, the emission speed of sound waves emitted from the gap between the central pair of flow plates 21 is set so as to be generally twice the emission speed of sound waves emitted from the gaps between the flow plates 21 on the inner side and the flow plates 22 on the outer side, by adjusting the tapering gap between the pair of flow plates 21 positioned generally at the center, and the gaps between the flow plates 21 and the flow plates 22 on the outer side. This spherical wave generating diffuser 3*b* is positioned and fixed to the speaker box 6 and with a slight gap as to the diaphragm 8 so as to not come into contact therewith.

In the above configuration, of the flow plates 21 and 22 making up the spherical wave generating diffuser 3*b*, the inner pair of flow plates 21 are formed in an inwardly tapered shape following the direction of sound wave emission, so the sound wave emission speed increases therebetween. On the other hand, the outer flow plates 22 are formed in an outwardly tapered shape following the direction of sound wave emission, so the sound wave emission speed decreases at the gaps formed between the inner flow plates 21 and the flow plates 22 on the outer side.

Accordingly, upon the diaphragm 8 of the cone type dynamic speaker 2 being vibrated within the piston movement frequency range and sound waves being emitted toward the spherical wave generating diffuser 3, the emission speed of sound waves emitted from the gap between the central pair of flow plates 21 is generally twice the emission speed of sound waves emitted from the gaps between the flow plates 21 and the flow plates 22 on the outer side. As a result, the overall emitted wave face of the spherical wave speaker is a pseudo-spherical wave W centered on the opening created by the gap between the pair of flow plates 21 on the inner side, as indicated by the third broken line.

Thus, the spherical wave speaker 1*b* according to the second embodiment yields the same advantages as with the above-described first embodiment. Moreover, with the second embodiment, a spherical wave generating diffuser 3*b* can be configured simply by arranging the flow plates 21 and 22 in parallel. Further, an optimal listening state can be easily obtained for a listening position by adjusting the inclination angle of the flow plates 21 and 22, or placing the spherical wave speaker 3*b* horizontally or vertically as shown in FIG. 3.

Third Embodiment

Figure 4:
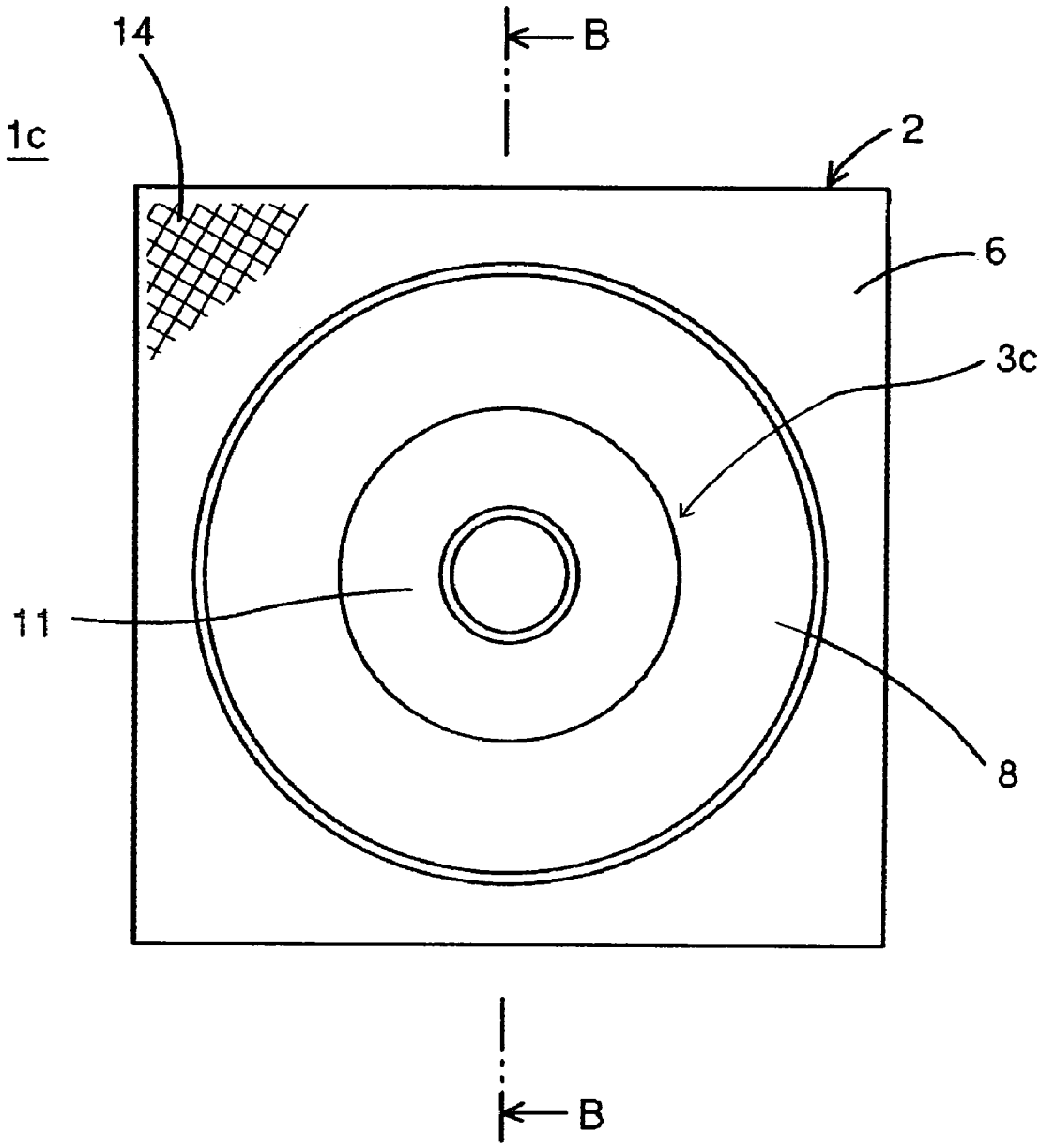
FIG. 4 is a front view illustrating a third embodiment of a speaker using the diffuser according to the present invention.
Figure 5:
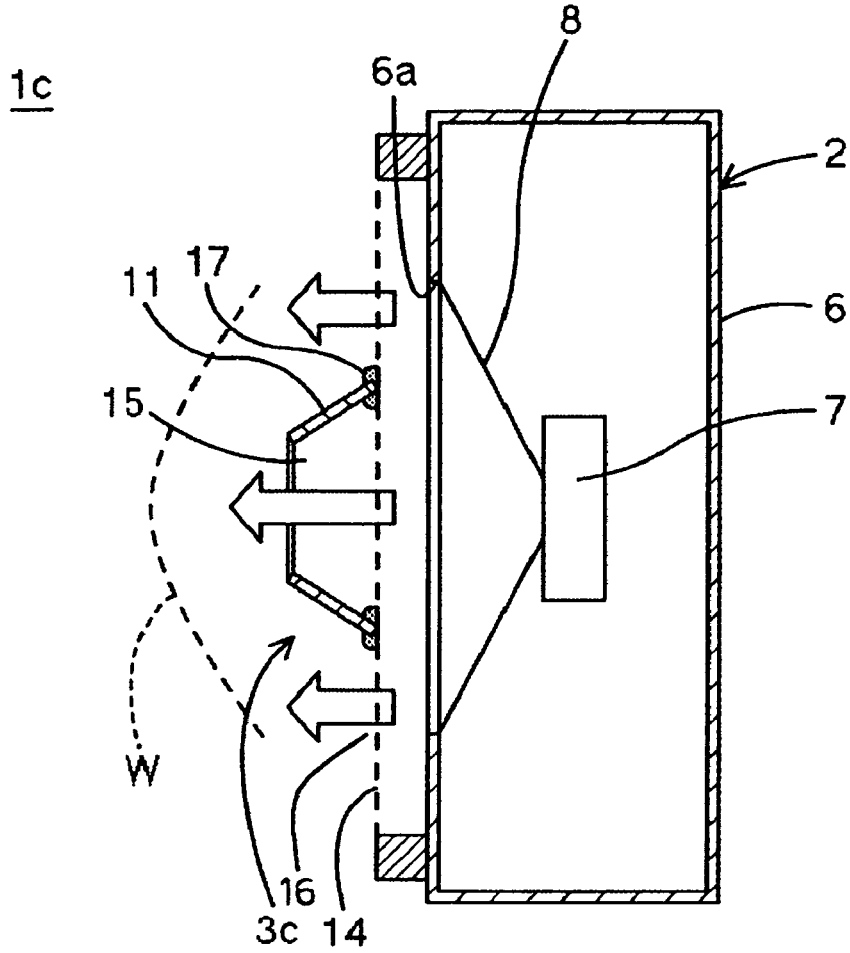
FIG. 5 is a cross-sectional view along line B-B in FIG. 4.

FIG. 4 and FIG. 5 are diagrams illustrating a third embodiment of a spherical wave speaker using the spherical wave generating diffuser according to the present invention, wherein FIG. 4 is a frontal view thereof, and FIG. 5 is a cross-sectional view along line B-B in FIG. 4.

The spherical wave speaker 1*c* according to the third embodiment is the same configuration as the spherical wave speaker 1 according to the first embodiment except for the point that the outer flow plate 12 and supporting rods 13 are missing, so portions with common functions will be denoted with the same reference numerals and detailed description thereof will be omitted.

The spherical wave speaker 1*c* shown in FIG. 4 and FIG. 5 includes a singular cone type dynamic speaker 2 and a spherical wave generating diffuser 3*c*.

The spherical wave generating diffuser 3*c* has a center flow plate 11 formed conically in a tapered manner with both ends opened along the direction of emission, and placed concentrically relative to the diaphragm 8. A horn is formed in the space surrounded by the flow plate 11. This horn has a tapered conical shape with both ends opened wherein the opening area of the sound wave output side is smaller than the opening area of the sound wave input side in the direction of sound wave emission, and is the same as the horn 15 in the first embodiment, and accordingly will be referred to as horn 15 hereafter. On the outer side thereof is formed an outer horn with a spatial configuration which is borderless on the outer side. Though no outer flow plate such as with the speaker 1*a* shown in FIG. 1 is provided, the open spatial configuration is configured on the outside by the inner flow plate 11 alone, and is referred to as horn 16.

In the above configuration, the inner horn 15 is formed such that the opening area of the sound wave output side is smaller than the opening area of the sound wave input side, and accordingly, the sound wave emission speed increases as compared to the emission speed of the sound waves emitted therearound, such that the overall emitted wave face is a pseudo-spherical wave W centered on the inner horn 15.

The center flow plate 11 of the spherical wave generating diffuser 3*c* is positioned on the speaker protective net 14 at the front side of the diaphragm 8 of the cone type dynamic speaker 2 concentrically with the diaphragm 8 and also with a slight gap as to the diaphragm 8 so as to not come into contact therewith, and is attached by an adhesive agent 17.

Attachment of the diffuser may be made integrally with or by fixing to a speaker frame or cabinet, using a bracket or the like, as with the first embodiment. However, while there is no problem with speakers designed from the beginning to mount the spherical wave generating diffuser, there are various attachment positions depending on the shape of the speaker diaphragm in the event of attaching the spherical wave generating diffuser later, leading to the following problem. That is, there is a wide variety of speaker frame hole positions, speaker edge shapes, available space of the housing, protective net frame shapes, and so on, which would require a wide range of attachments and brackets to handle, leading to increased work in attaching and also increased costs.

However, attaching the diffuser to the protective net 14 allows easy and inexpensive attachment to already-existing speakers. Attachment with an adhesive agent enables application to a wide range of speakers, since no parts are required in particular for attachment.

With the spherical wave speaker 1*c* of the above-described configuration, upon the diaphragm 8 being vibrated within the piston movement frequency range by the driver 7 of the cone type dynamic speaker 2, sound waves are emitted toward the spherical wave generating diffuser 3.

Now, the center flow plate 11 of the spherical wave generating diffuser 3*c* is formed in a tapered conical shape with both ends opened, so the opening area of the sound wave output side is smaller than the opening area of the sound wave input side, and accordingly, the sound wave emission speed increases. On the other hand, immediately outwards thereof is partitioned by the center flow plate 11 so sound waves therearound are emitted in a widening manner, and accordingly, the sound wave emission speed decreases. Consequently, the emission speed of sound waves emitted from the inner horn 15 can be made to be faster than the emission speed of sound waves emitted from the outer side of the inner horn 15, and can be made to be twice. As a result, the overall emitted wave face of the spherical wave speaker 1*c* is a pseudo-spherical wave W centered on the inner horn 15.

Using the spherical wave generating diffuser 3*c* allows a spherical wave speaker 1*c* to be easily realized using an already-existing speaker 2, which can lead to broader applications and also further reduction in price.

Also, the spherical wave speaker 1*c* according to the third embodiment is of a configuration wherein the spherical wave generating diffuser 3*c* is attached to the protective net 14. With such a configuration, the protective net is of a material which has air permeability and flexibility, so there is no generation of unwanted noise at the spherical wave generating diffuser attachment portion. With this configuration, the diffuser is attached to the front face of the protective net 14 with an adhesive agent, so attachment to the speaker frame or housing is unnecessary, meaning that these are not damaged thereby, and also, configuration can be made without being restricted by the shapes of the speaker diaphragm, edge, frame, cabinet, etc. Also, the spherical wave generating diffuser can be easily attached and detached, and can be easily transplanted to other speakers.

Also, attachment is performed simply with the spherical wave generating diffuser and adhesive agent, without specialized attachment pieces or tools being required, so attachment is easy, standardization can be made for a wide range of speakers, and size can be reduced with even further reductions in cost. Moreover, effects of the spherical wave generating diffuser can be easily confirmed by attaching and detaching the protective net.

Fourth Embodiment

Figure 6:
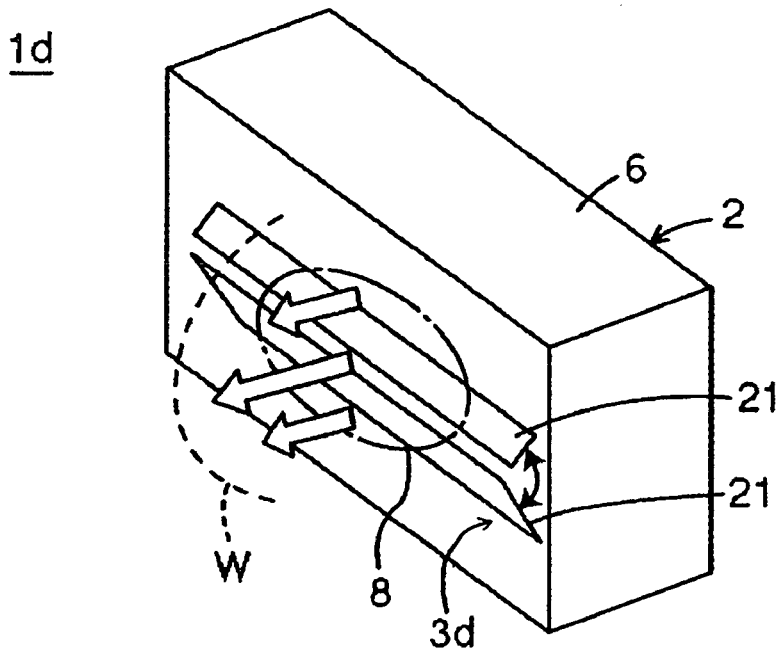
FIG. 6 is a cross-sectional view illustrating another example of a fourth embodiment of a speaker using the diffuser according to the present invention.

FIG. 6 is a perspective view illustrating a fourth embodiment of a spherical wave speaker using the spherical wave generating diffuser according to the present invention.

The spherical wave speaker 1*d* according to this fourth embodiment is configured of a singular cone type dynamic speaker 2 and a spherical wave generating diffuser 3*d*.

This spherical wave speaker 1*d* is the same configuration as the spherical wave speaker 1 according to the second embodiment except for the point that the outer flow plates are missing, so portions with common functions will be denoted with the same reference numerals and detailed description thereof will be omitted.

The spherical wave generating diffuser 3*d* according to this fourth embodiment has two flow plates 21 provided in parallel with each other, with a predetermined spacing therebetween, and inclined at a predetermined angle along the sound wave emission direction (indicated by arrows in the drawing). That is to say, the pair of flow plates 21 positioned at the generally center portion of the diaphragm 8 of the cone type dynamic speaker 2 are disposed in an inclined manner so as to be tapered inwardly in the direction of sound wave emission so as to form the inner horn 15 with the opened spatial structure at the center portion, and an outer horn is formed on the outer side thereof of the borderless spatial structure excluding the inner side thereof.

Moreover, the emission speed of sound waves emitted from the gap between the central pair of flow plates 21 can be set so as to be generally twice the emission speed of sound waves emitted from the gaps between the flow plates 21 on the inner side and the outer side thereof, by adjusting the tapering gap between the pair of flow plates 21 positioned generally at the center.

This spherical wave generating diffuser 3*d* is positioned in front of the diaphragm 8 of the cone type dynamic speaker 2 with a slight gap as to the diaphragm 8 so as to not come into contact therewith, and is adhered to the outer side (front) of the protective net 14 of the speaker box 6 with an adhesive agent.

In the above configuration as well, the sound wave emission speed increases between the inner pair of flow plates 21 making up the spherical wave generating diffuser 3*d*. On the other hand, the immediately outer side is shielded by the inner flow plates 21, so the emission speed of sound waves therearound decreases. As a result, the overall emitted wave face of the spherical wave speaker is a pseudo-spherical wave W centered on the inner horn 15 (not conical in this case) between the inner pair of flow plates 21, as indicated by the broken line in FIG. 6.

Thus, the spherical wave speaker 1*d* according to the fourth embodiment yields the same advantages as with the above-described first embodiment. Moreover, with the fourth embodiment, a spherical wave generating diffuser 3*d* can be configured simply by arraying the flow plates 21 in parallel without providing the center flow plate 11 which is conical with both ends opened, or multiple pairs 21 and 22, so fabrication is easy and costs can be kept low. Further, an optimal listening state can be easily obtained for a listening position by adjusting the inclination angle of the flow plates 21, or placing the spherical wave speaker 3*d* horizontally or vertically.

Figure 7:
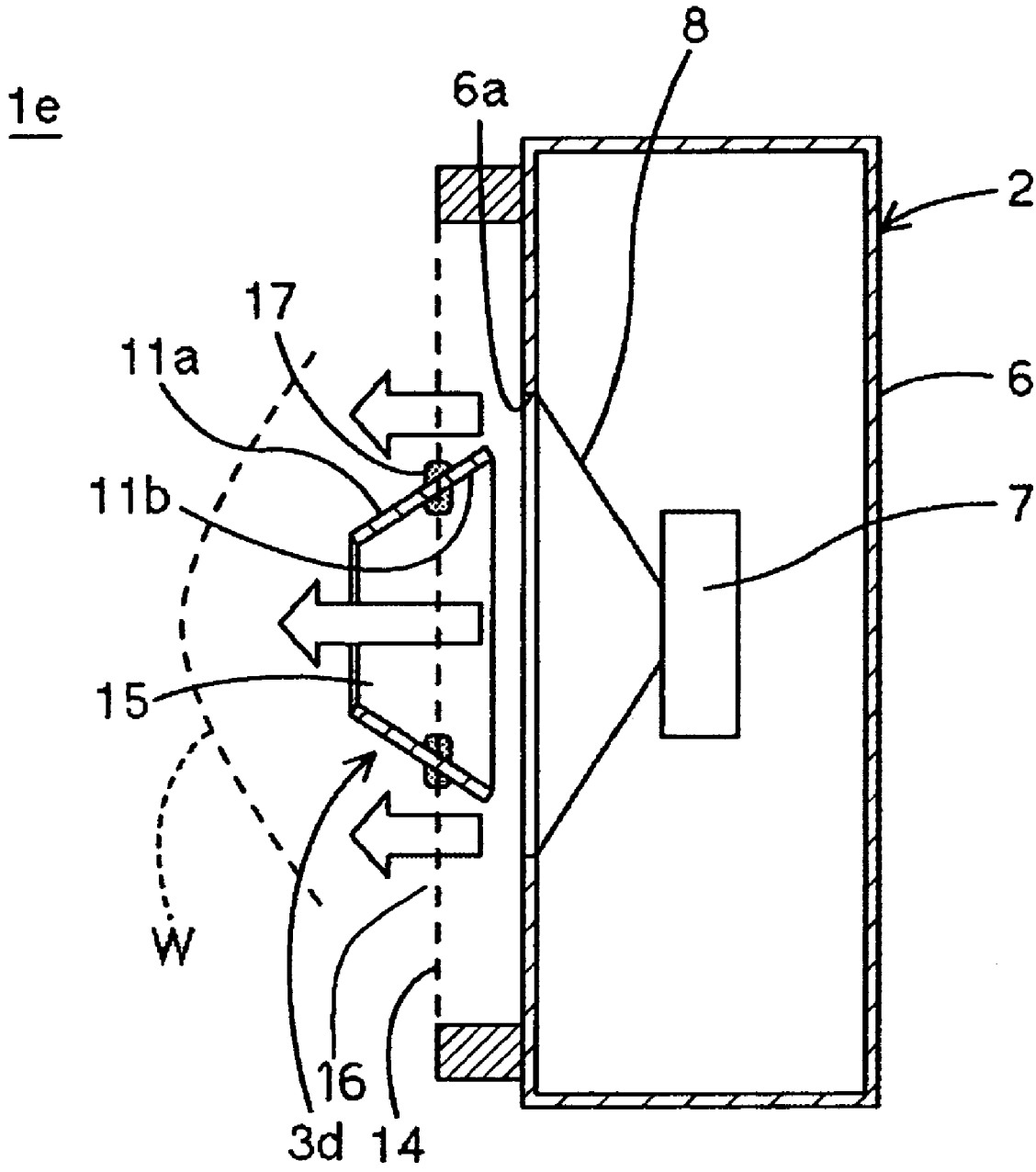
FIG. 7 is a cross-sectional view illustrating another example of the third embodiment of a speaker using the diffuser according to the present invention.

FIG. 7 is a cross-sectional view of illustrating another example of the third embodiment of a spherical wave speaker using the spherical wave generating diffuser according to the present invention.

The spherical wave speaker 1*e* according to this example is configured of a single cone type dynamic speaker 2 and a spherical wave generating diffuser 3*d*. This arrangement differs from the above-described third embodiment only in the method of attaching the spherical wave generating diffuser 3*c*, so portions with the same operations will be denoted with the same reference numerals and detailed description thereof will be omitted.

The spherical wave speaker 1*e* is configured of a cone type dynamic speaker 2, and a spherical wave generating diffuser 3*d* which sandwiches the protective net 14 concentrically with the diaphragm 8.

The spherical wave generating diffuser 3*c* is configured of a front flow plate 11*a* and a rear flow plate 11*b* which are divided to as to be provided to the front and rear of the protective net 14 and adhered by an adhesive agent. The front flow plate 11*a* at the front side of the protective net 14 is formed conically in a tapered manner with both ends opened following the direction of sound wave emission such that the opening area of the sound wave output side is smaller than the opening area of the sound wave input side. In the same way, the rear flow plate 11*b* at the back side of the protective net 14 is formed conically in a tapered manner with both ends opened following the direction of sound wave emission such that the opening area of the sound wave output side is smaller than the opening area of the sound wave input side. Overall, the front flow plate 11*a* and the rear flow plate 11*b* are formed tapered toward the front, with the inner horn 15 having a conical form tapered toward the front and with both ends opened being formed on the inner side thereof, and the outer horn 16 formed out the outer side thereof.

Attaching the spherical wave generating diffuser 3*d* in this way enables spatial restrictions at the front of the speaker to be further reduced in addition to the advantages of configuring the speaker according to the above-described third embodiment, so the desired performance can be easily obtained.

Figure 8:
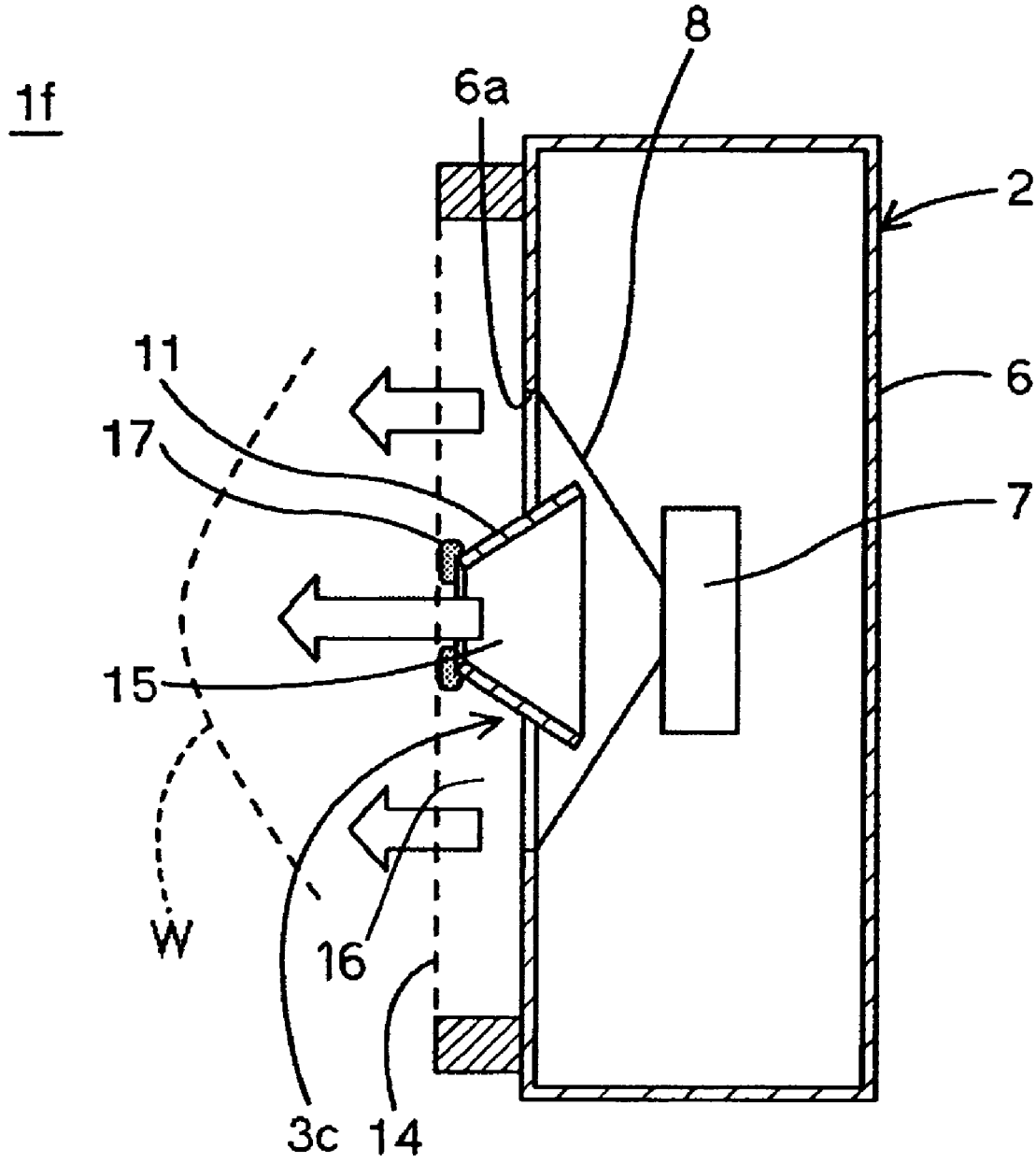
FIG. 8 is a cross-sectional view illustrating yet another example of the third embodiment of a speaker using the diffuser according to the present invention.

FIG. 8 is a cross-sectional view of illustrating yet another example of the third embodiment of a spherical wave speaker using the spherical wave generating diffuser according to the present invention.

The spherical wave speaker 1*f* according to this example is configured of a single cone type dynamic speaker 2 and the spherical wave generating diffuser 3*c*. This arrangement differs from the above-described third embodiment only in the method of attaching the spherical wave generating diffuser 3*c*, so portions with the same operations will be denoted with the same reference numerals and detailed description thereof will be omitted.

The spherical wave speaker 1*f* has the inner horn 15 and the outer horn 16 of the spherical wave generating diffuser 3*c* positioned concentrically with the diaphragm 8 of the cone type dynamic speaker 2. The spherical wave generating 3*c* is formed with the flow plate 11 being adhered to the rear face of the protective net 14 with an adhesive agent.

Note that the flow plate 11 may be positioned such that the rear portion of the flow plate 11 and the front portion of the diaphragm 8 partially overlap each other, as shown in FIG. 8.

Attaching the spherical wave generating diffuser 3*c* in this way stores the diffuser within the speaker box 6 behind the protective net, which enables spatial restrictions at the front of the speaker to be further reduced and the diffuser to be protected by the protective net, in addition to the advantages of configuring the speaker according to the above-described third embodiment.

Figure 9:
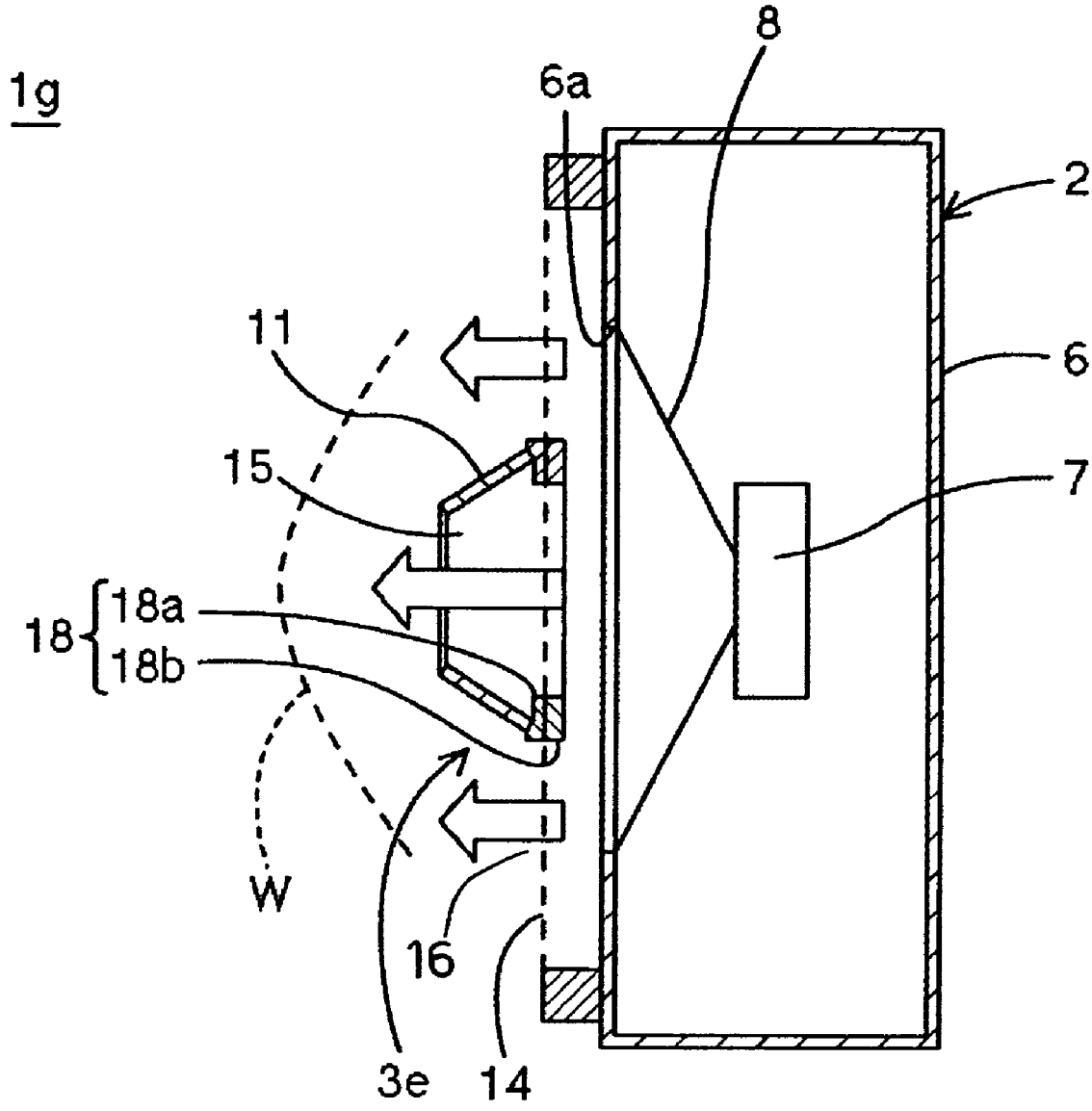
FIG. 9 is a cross-sectional view illustrating yet another example of the third embodiment of a speaker using the diffuser according to the present invention.

FIG. 9 is a cross-sectional view of illustrating yet another example of the third embodiment of a spherical wave speaker using the spherical wave generating diffuser according to the present invention.

The spherical wave speaker 1*g* according to this example is configured of a single cone type dynamic speaker 2 and a spherical wave generating diffuser 3*e*. This arrangement differs from the above-described third embodiment only in the method of attaching the spherical wave generating diffuser 3*e*, so portions with the same operations will be denoted with the same reference numerals and detailed description thereof will be omitted.

The spherical wave speaker 1*g* has the inner horn 15 and the outer horn 16 of the spherical wave generating diffuser 3*e* positioned concentrically with the diaphragm 8 of the cone type dynamic speaker 2. The spherical wave generating diffuser 3*e* has a connecting member 18, and is fixed to the protective net 14 by the connecting member 18.

The connecting member 18 shown in FIG. 9 is configured of a magnet or ferromagnetic adsorbing member 18*a* attached to the spherical wave generating diffuser 3*e* and a fixing member 18*b* positioned across the protective net 14. The fixing member 18*b* is formed of a ferromagnetic member or a magnet which effects magnetic adsorption with the adsorbing member 18*a*.

Forming the spherical wave generating diffuser 3*e* in this way allows positional adjustment to be easily performed owing to the magnetic adsorption, meaning that attachment is easy, and a spherical wave speaker can be obtained inexpensively.

Figure 10:
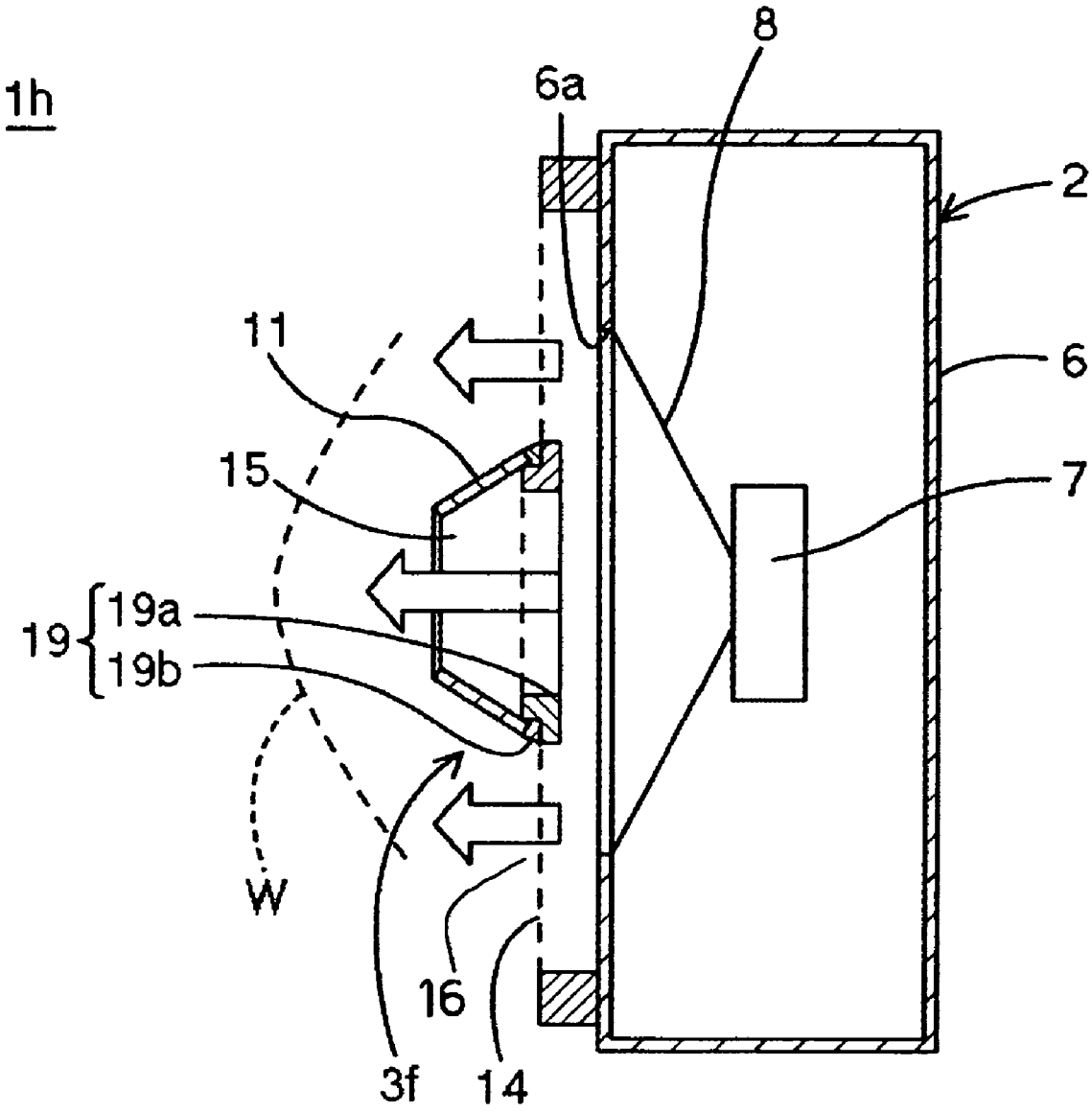
FIG. 10 is a cross-sectional view illustrating yet another example of the third embodiment of a speaker using the diffuser according to the present invention.

FIG. 10 is a cross-sectional view of illustrating yet another example of the third embodiment of a spherical wave speaker using the spherical wave generating diffuser according to the present invention.

The spherical wave speaker 1*h* according to this example is configured of a single cone type dynamic speaker 2 and a spherical wave generating diffuser 3*f*. This spherical wave speaker 1*h* differs from the above-described third embodiment only in the method of attaching the spherical wave generating diffuser 3*f*, so portions with the same operations will be denoted with the same reference numerals and detailed description thereof will be omitted.

The spherical wave generating diffuser 3*f* shown in FIG. 10 has a connecting member 19, so as to be fixed to the protective net 14. The connecting member 19 is configured of a detachable clip-ring 19*a*, a fitting portion 19*b* fixed to the spherical wave generating diffuser 3*f*, and so forth. The spherical wave generating diffuser 3*f* is fixed to the protective net by fitting the clip-ring 19*a* to the fitting portion 19*b* across the protective net 14, thereby mounting the spherical wave generating diffuser 3*f*.

Configuring the spherical wave speaker as with this example facilitates attaching, enables a spherical wave speaker to be obtained inexpensively, and enables speaker performance to be improved, in addition to the advantages of configuring the speaker according to the above-described third embodiment.

Also, the method for fixing the diffuser to the protective net and for fixing the diffuser to the speaker is not restricted to the above method, and may be configured of bolts, pins, or the like. A configuration which uses small connecting members with small area and so forth, such as bolts, pins, or the like, facilitates attaching, enables a spherical wave speaker to be obtained inexpensively, and enables speaker performance to be improved, in addition to the advantages of configuring the speaker according to the above-described third embodiment.

Fifth Embodiment

Figure 11:
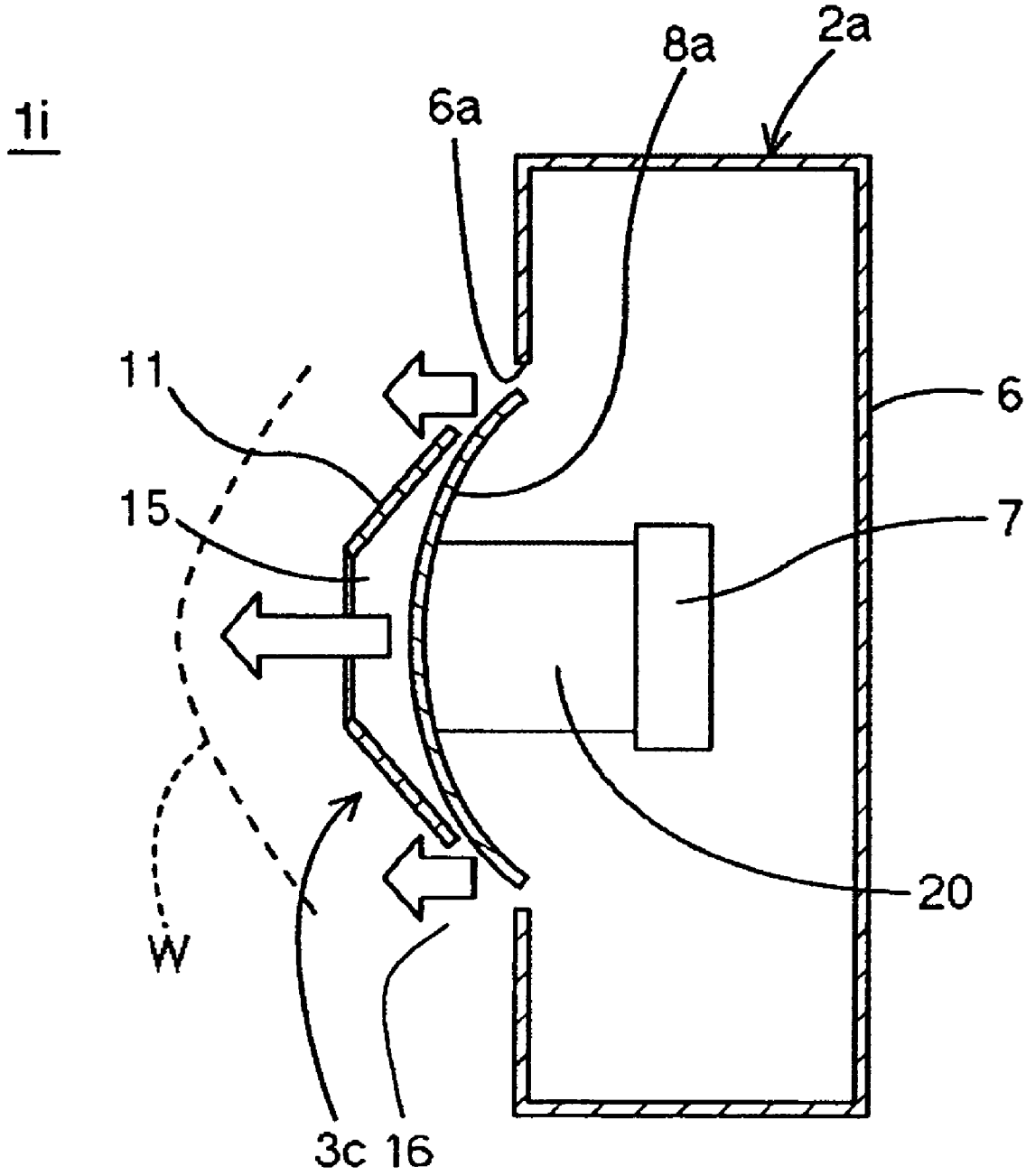
FIG. 11 is a cross-sectional view illustrating an example of a fifth embodiment of a speaker using the diffuser according to the present invention.

FIG. 11 is a cross-sectional view of illustrating a fifth embodiment of a spherical wave speaker using the spherical wave generating diffuser according to the present invention.

This embodiment differs from the above-described third embodiment only in that a dome type dynamic speaker is used, so portions with the same operations will be denoted with the same reference numerals and detailed description thereof will be omitted. Unlike the dome speaker disclosed in Patent Document 1, this one does not perform vibration.

The spherical wave speaker 1*i* shown in FIG. 11 is configured of a single dome type dynamic speaker 2*a* and a spherical wave generating diffuser 3*c*.

The spherical wave speaker 1*i* has the spherical wave generating diffuser 3*c* positioned in front of the diaphragm 8*a* which is the sound source, concentrically with the diaphragm 8*a*, somewhat away therefrom. The inner horn 15 and outer horn 16 of the spherical wave generating diffuser 3*c* are formed concentrically with the diaphragm 8*a* of the dome type dynamic speaker 2*a*. The flow plate 11 of the spherical wave generating diffuser 3*c* is positioned such that the rear end thereof is brought back to a position slightly behind the front tip of the diaphragm 8*a*.

The dome type dynamic speaker 2*a* has the driver 7 provided within the speaker box 6, with the dome type diaphragm 8*a* being attached to the driver 7. The diaphragm 8*a* is provided so as to partially protrude out from an opening 6*a* formed at the front face of the speaker box 6, with the inner horn 15 formed at the middle front portion thereof and the outer horn 16 formed on the outer side thereof. Reference numeral 20 in FIG. 11 denotes a drive transmitting member.

Attaching the spherical wave generating diffuser 3*c* thus enables spherical waves to be obtained, the same as with a case of configuring the speaker according to the above third embodiment.

Sixth Embodiment

Figure 12:
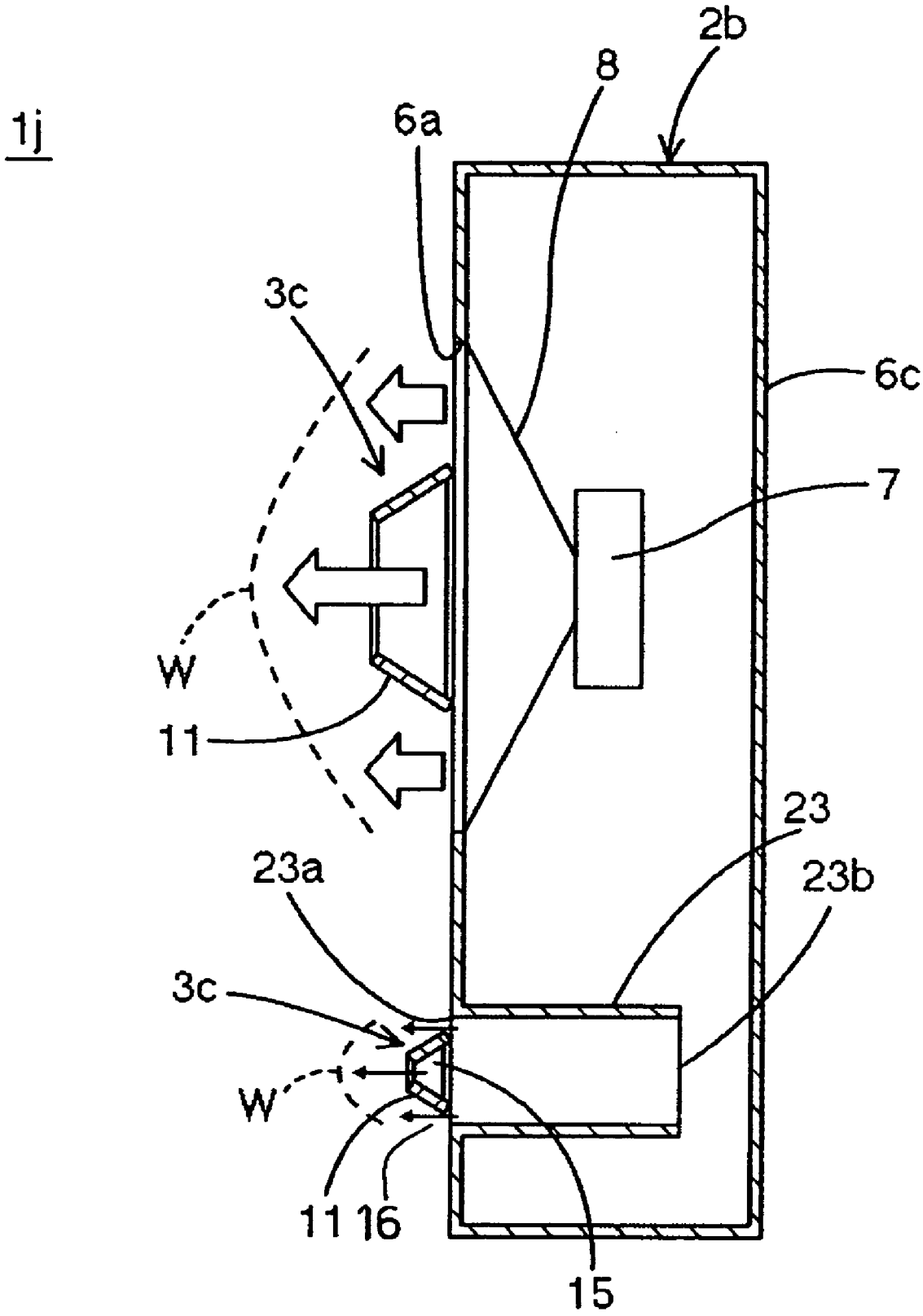
FIG. 12 is a cross-sectional view illustrating an example of a sixth embodiment of a speaker using the diffuser according to the present invention.

FIG. 12 is a cross-sectional view of illustrating a sixth embodiment of a spherical wave speaker using the spherical wave generating diffuser according to the present invention.

The spherical wave speaker according to the present embodiment differs from the above-described third embodiment only in that a bass reflex port is provided to the speaker box of the cone type dynamic speaker, and that a spherical wave generating diffuser is also provided to the bass reflex port, so portions with the same operations will be denoted with the same reference numerals and detailed description thereof will be omitted.

The spherical wave speaker 1*j* shown in FIG. 12 is configured of a single cone type dynamic speaker 2*b*, a bass reflex port 23 formed within the speaker box 6, and a spherical wave generating diffuser 3*c* disposed at the front of the bass reflex port 23.

The bass reflex port 23 is hollow with both ends opened, has a predetermined length, is provided so as to communicate between the interior of the speaker box 6*c* and the outer open space in front of the speaker box, and has a frontal opening 23*a* at the front which is different from the opening 6*a* of the speaker box. The spherical wave generating diffuser, formed of the tapered conical flow plate 11, is disposed at the center portion in front of the frontal opening 23*a*.

With this spherical wave speaker 1*j*, sound waves emitted from the diaphragm 8 are emitted from the opening 6*a* of the speaker box, and also emitted from the bass reflex port 23. Accordingly, the frontal opening 23*a* of the bass reflex port 23 serves as the boundary face where waves (planar waves) of air particles with matching compression wave phases in the direction of travel of sound waves are emitted into open space, and accordingly serves as the sound source.

With this embodiment, full spherical waves with an even wider bass range can be obtained, in addition to the advantages of configuring the speaker according to the above-described embodiments.

Figure 13:
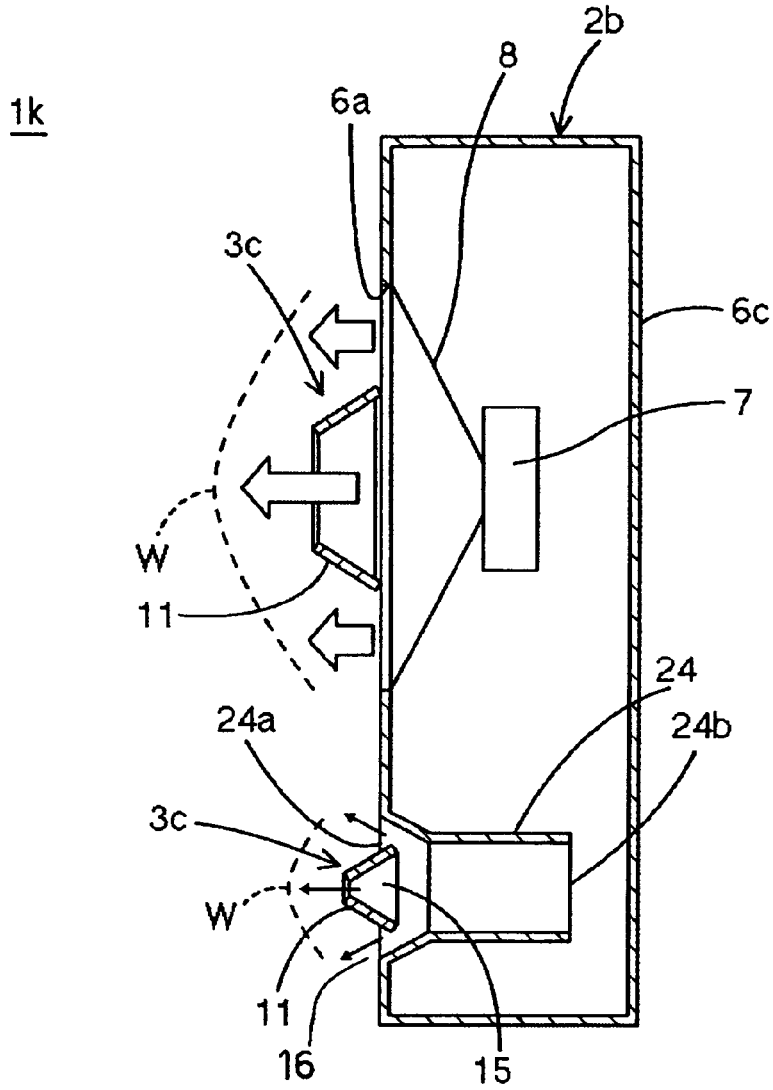
FIG. 13 is a cross-sectional view illustrating an example of a seventh embodiment of a speaker using the diffuser according to the present invention.

FIG. 13 is a cross-sectional diagram illustrating the principal components of another example of the sixth embodiment.

The spherical wave speaker 1*k* in this example differs from the sixth embodiment only in that the form of the bass reflex port is different and that the position of the spherical wave generating diffuser is somewhat different, so portions with the same operations will be denoted with the same reference numerals and detailed description thereof will be omitted.

The spherical wave speaker 1*k* shown in FIG. 13 is configured of a single cone type dynamic speaker 2*b* having a bass reflex port 24 provided within the speaker box 6*c*, and a spherical wave generating diffuser 3*c* disposed at the front of the bass reflex port 24.

The bass reflex port 24 has a frontal opening 24*a* which is widened from the front forward, and a spherical wave generating diffuser 3*c* having a tapered conical shape is positioned at the center portion of the frontal opening 24*a* of the bass reflex port 24 so as to be slightly within the bass reflex port 24.

With this embodiment, full spherical waves with an even wider bass range can be obtained, in addition to the advantages of configuring the speaker according to the above-described embodiments.

Seventh Embodiment

Figure 14:
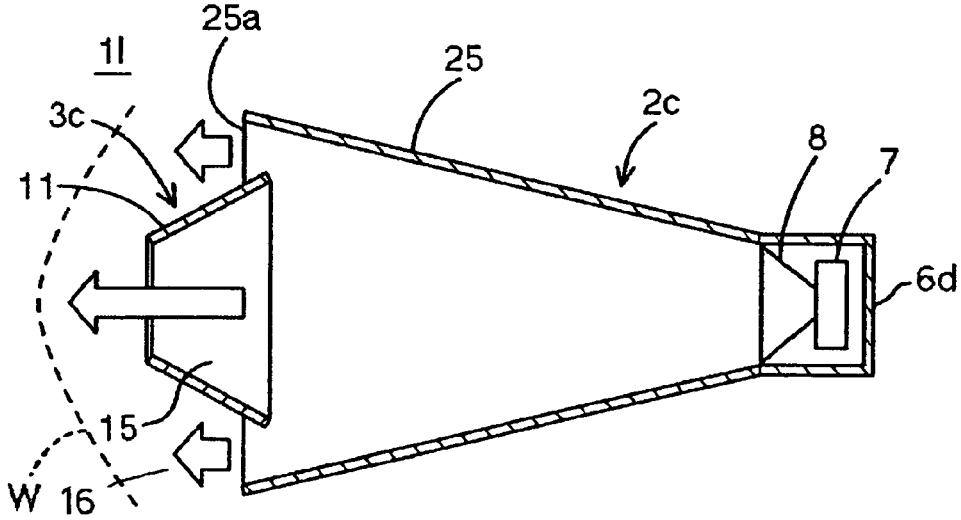
FIG. 14 is a cross-sectional view illustrating another example of the seventh embodiment of a speaker using the diffuser according to the present invention.

FIG. 14 is a cross-sectional view of illustrating a seventh embodiment of a spherical wave speaker using the spherical wave generating diffuser according to the present invention.

This embodiment differs from the above-described third embodiment only in that a horn member is provided extended in the emission direction of the diaphragm, and that the spherical wave generating diffuser is disposed at the front portion of the horn member, so portions with the same operations will be denoted with the same reference numerals and detailed description thereof will be omitted.

The spherical wave speaker 11 shown in FIG. 14 is configured of a single cone type dynamic speaker 2*c*, a horn member 25 extended in the emission direction of the diaphragm 8, and a spherical wave generating diffuser 3*c*.

The cone type dynamic speaker 2*c* has a driver 7 and diaphragm 8, and has a horn member 25 in this example. The horn member 25 extends in the direction of emission of sound emitted from the diaphragm 8, widens in cross-sectional diameter toward the front, and the front end thereof is opened to form an opening 25*a*. In this case, the proximity of the opening 25*a* of the horn member 25 is the sound source as defined in the present application. The spherical wave generating diffuser 3*c* is provided at the center of the front of the opening 25*a*, so as to be somewhat within the opening 25*a*.

This embodiment enables advantages to be obtained in the same way as configuring speakers according to the above embodiments.

Figure 15:
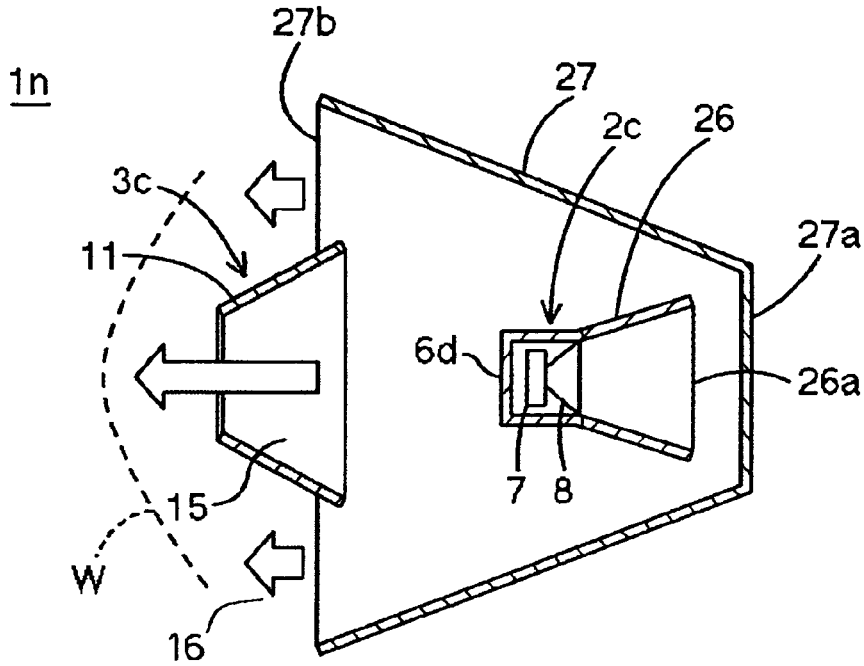
FIG. 15 is a cross-sectional view illustrating yet another example of the seventh embodiment of a speaker using the diffuser according to the present invention.

FIG. 15 is a cross-sectional view of illustrating another example of the seventh embodiment of a spherical wave speaker using the spherical wave generating diffuser according to the present invention.

The speaker in this arrangement differs from the above-described seventh embodiment only in the horn member, so portions with the same operations will be denoted with the same reference numerals and detailed description thereof will be omitted.

The spherical wave speaker in shown in FIG. 15 is configured of a single cone type dynamic speaker 2, a rear horn member 26 extended enlarging backwards, a front horn member 27 which reverses the direction of sound waves and extends enlarging forwards, and a spherical wave generating diffuser 3*c*.

The rear horn member 26 has a horn shape opened on both ends, sequentially enlarging in cross-sectional area from one end to the other, and one end thereof opening toward the diaphragm 8. The other end extends backwards in the emission direction of sound emitted from the diaphragm 8 and the cross-sectional area thereof enlarges in the direction of sound waves advancing (toward the back of the speaker). The sound waves emitted form the diaphragm 8 are then emitted from the opened opening 26*a* to the rear portion of the front horn member 27 situated behind.

The front horn member 27 has a sealed rear end 27*a*, forming a conical shape with the front end opened, and the sound waves emitted form the rear horn member 26 are shielded and reversed in direction at the rear end 27*a* and emitted forwards. The diffuser 3*c* is disposed at the front center portion of the opened end portion 27*b* of the front horn member 27.

Due to such a configuration of the spherical wave speaker 1*n*, this embodiment modification enables advantages to be obtained in the same way as configuration speakers according to the above embodiments.

Eighth Embodiment

Figure 16:
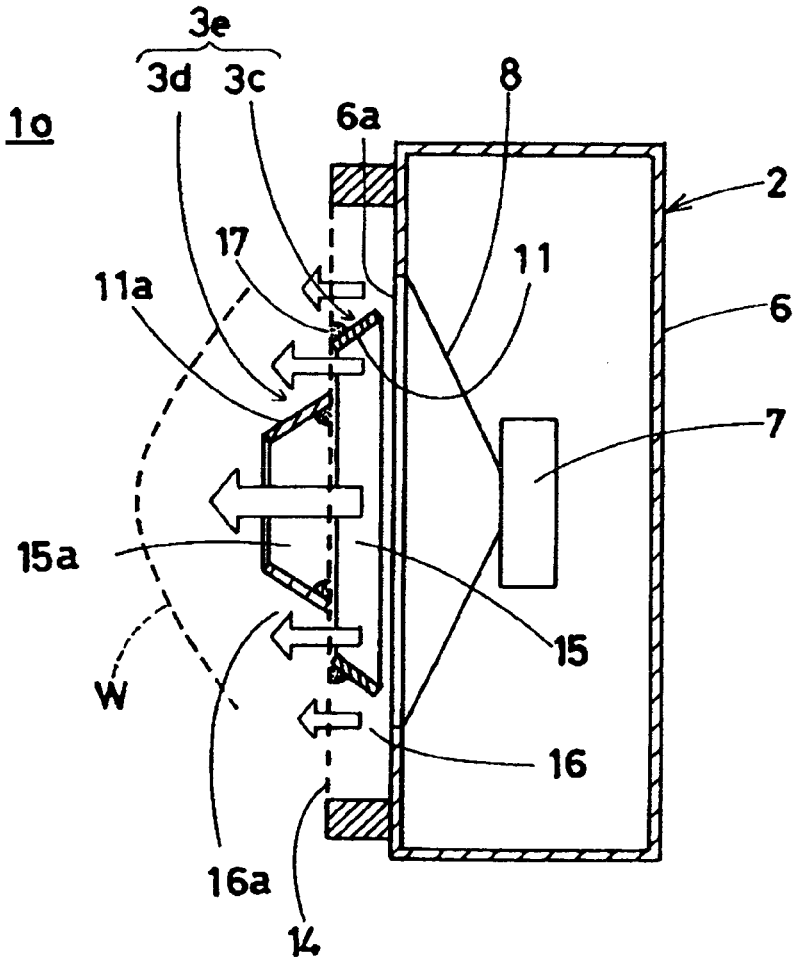
FIG. 16 is a cross-sectional view illustrating an eighth embodiment of a speaker using the diffuser according to the present invention.

FIG. 16 is a cross-sectional view of illustrating an eighth embodiment of a spherical wave speaker using the spherical wave generating diffuser according to the present invention.

The spherical wave speaker 1*o* according to this embodiment is configured of a single cone type dynamic speaker 2 and a spherical wave generating diffuser 3*e*. This embodiment differs from the above-described third embodiment only in that the spherical wave generating diffuser 3*e* is different, so portions with the same operations will be denoted with the same reference numerals and detailed description thereof will be omitted.

The spherical wave generating diffuser 3*e* is configured of a spherical wave generating diffuser 3*c* and another frontal diffuser 3*d* having a structure tapered in the forward direction along the sound wave emission direction of the spherical wave generating diffuser 3*c*.

The spherical wave generating diffuser 3*c* is configured of a flow plate 11 adhered to the rear face of the protective net 14 by an adhesive agent. Also, the frontal diffuser 3*d* is configured of a frontal flow plate 11*a* adhered to the front face of the protective net 14 by an adhesive agent. Both the flow plate 11 and the frontal flow plate 11*a* are formed conically in a tapered manner with both ends opened following the direction of sound wave emission such that the opening area of the sound wave output side is smaller than the opening area of the sound wave input side. Further, the rear opening area of the frontal flow plate 11*a* is formed smaller than the front opening area of the flow plate 11.

The spherical wave generating diffuser 3*c* forms an inner horn 15, from the sound wave input side of the tapered open space configuration with the flow plate 11, along the direction of sound emission, and an outer horn 16 having an open space configuration on the outer side thereof. Further, the frontal diffuser 3*d* is placed by the flow plate 11*a* at a region including the generally center portion facing the sound source of the tapered opening end of the inner horn 15, so as to form another inner horn 15*a* having a tapered opened space configuration, and an outer horn 16*a* having an opened space configuration on the outer side thereof.

Thus, attaching multiple spherical wave generating diffusers with steps at the adjacent opening ends as with the spherical wave generating diffuser 3*c* and the frontal diffuser 3*d* enables the center opening end of the speaker front (the tip of the spherical wave generating diffuser) to be reduced even further in the event that the sound source is large, in addition to the advantages of configuring the speaker according to the above-described third embodiment. Consequently, a point sound source is even further approximated, and delicate reproduction with little roughness can be obtained.

Also, while the eighth embodiment has been described with an example wherein the flow plates configuring the diffuser are formed conically in a tapered manner with both ends opened following the direction of sound wave emission such that the opening area of the sound wave output side is smaller than the opening area of the sound wave input side; however, flow plates are not restricted to this example. For example, two flow plates may be provided in parallel with each other at predetermined spacing introduced therebetween, and inclined at a predetermined angle along the sound wave emission direction such that the front side is narrower. Flow plates may be disposed adjacently across a spacing from the opening end so as to form a diffuser. Also, a diffuser may be formed by disposing outer flow plates on the outer side of the tapered flow plates situated at the generally center portion of the sound source, inclined outwardly along the sound wave emission direction. Moreover, an outer end horn of a borderless spatial structure excluding the inner side may be formed on the outer side of the outer horn formed of the opened spatial structure of the center flow plates and outer flow plates. Further, three or more stages of flow plates may be formed on the outer side of the tapered flow plate situated at generally the center of the sound source in the direction of sound wave emission to configure a diffuser. Increasing the number of stages forms a small tapered inner horn at the center of the foremost portion, which enables a smaller center opening end to be formed, whereby a point sound source is even further approximated.

Figure 17:
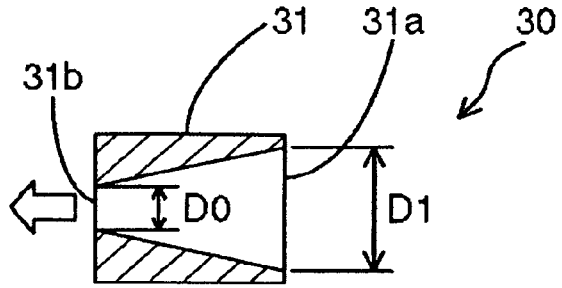
FIG. 17 is a cross-sectional view illustrating another example of the diffuser according to the present invention.

FIG. 17 is a cross-sectional view of illustrating yet another example of a spherical wave speaker.

The spherical wave generating diffuser in this example differs from the spherical wave generating diffuser in the above-described third embodiment only in the configuration of the flow plate, so the detailed description thereof will be omitted.

The spherical wave generating diffuser 30*a* shown in FIG. 17 is configured of a flow plate 31 in a tapered shape with both ends opened. The flow plate 31 has an interior formed conically with both ends opened and the outer shape being cylindrical, with an opening 31*a* formed at the rear opening end at one end and an opening 31*b* formed at the front opening end at the other end. With the diameter (cross-sectional area) of the opening 31*a* as D1 (S1) and the diameter (cross-sectional area) of the opening 31*b* as D0 (S0), the configuration is such that D1 (S1)>D0 (S0) holds, thereby realizing a tapered shape.

The spherical wave generating diffuser 30*a* has a hollow tapered conical shape with both ends opened, so the opening area of the sound wave output side is smaller than the opening area of the sound wave input side, and accordingly, the sound wave emission speed increases.

Figure 18:
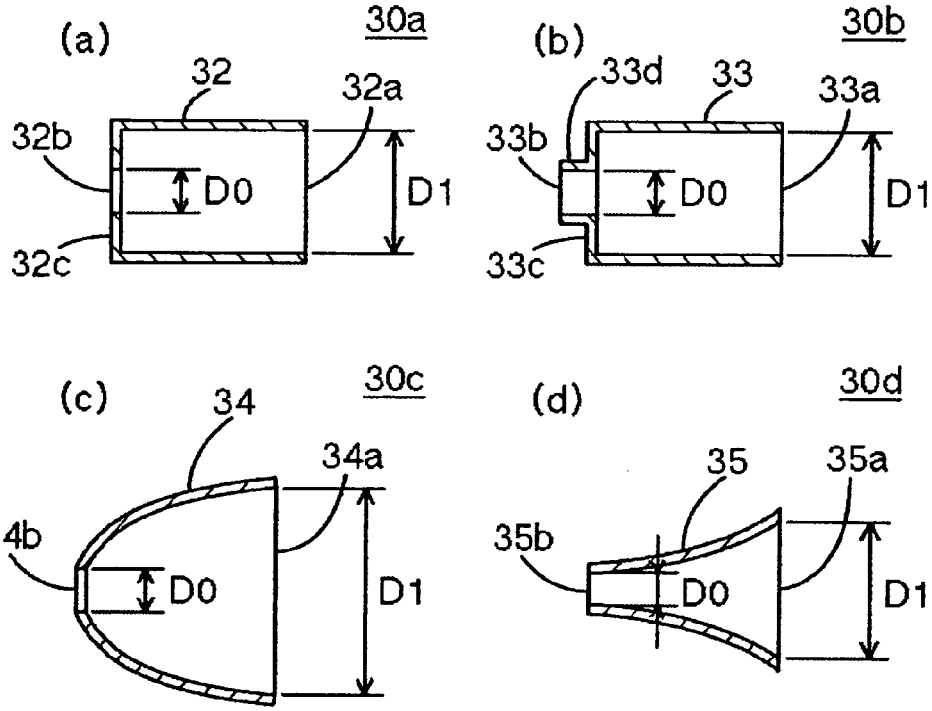
FIG. 18 shows various cross sectional views of diffusers according to the present invention.

FIG. 18 is cross-sectional views illustrating further examples of a spherical wave generating diffuser.

The spherical wave generating diffuser 30*a* shown in FIG. 18(*a*) has a flow plate 32. The flow plate 32 is hollow inside and one end has an opened opening 32*a*, with the other having a base 32*c* in which an opening 32*b* is provided, thereby forming a cylinder with a bottom. With the diameter (cross-sectional area) of the openings on either end as D1 (S1) and D0 (S0) respectively, the configuration is such that D1 (S1) >D0 (S0) holds, thereby realizing a tapered shape.

The flow plate 32 has a hollow tapered conical shape with both ends opened, so the opening area of the sound wave output side is smaller than the opening area of the sound wave input side, and accordingly, the sound wave emission speed increases. On the other hand, the immediately outer side is shielded by the flow plate, so sound waves therearound are emitted in a spatulate manner, and the emission speed thereof decreases. As a result, overall, pseudo-spherical waves centered on the flow plate 32 are obtained.

The spherical wave generating diffuser 30*b* shown in FIG. 18(*b*) has a flow plate 33. The flow plate 33 is hollow inside and one end has an opened opening 33*a*, with the other having a base 33*c* to which an nozzle 33*d* having an opening 33*b* is provided, thereby forming a cylinder with a bottom. With the diameter (cross-sectional area) of the openings on either end as D1 (S1) and D0 (S0) respectively, the configuration is such that D1 (S1)>D0 (S0) holds, thereby realizing a tapered shape.

The spherical wave generating diffuser 30*c* shown in FIG. 18(*c*) has a flow plate 33.

The flow plate 33 is hollow inside and one end has an opened opening 33*a*, with the other having an opening 33*b*, and the diameter of the body (cross-sectional area) changes following a curve. With the diameter (cross-sectional area) of the openings on either end as D1 (S1) and D0 (S0) respectively, the configuration is such that D1 (S1)>D0 (S0) holds, thereby realizing a tapered shape. As a result, overall, pseudo-spherical waves centered on the flow plate 33 are obtained.

The spherical wave generating diffuser 30*d* shown in FIG. 18(*d*) has a cylindrical flow plate 34. The flow plate 34 is hollow inside and one end has an opened opening 34*a*, with the other having an opening 34*b*, and the diameter of the body (cross-sectional area) changes following a curve. With the diameter (cross-sectional area) of the openings on either end as D1 (S1) and D0 (S0) respectively, the configuration is such that D1 (S1)>D0 (S0) holds, thereby realizing a tapered shape. As a result, overall, pseudo-spherical waves centered on the flow plate 34 are obtained.

Figure 19:
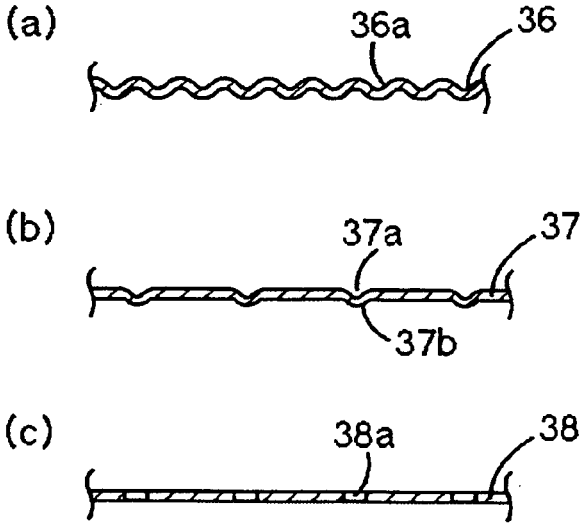
FIG. 19 shows partial cross sectional views of flow plates according to the present invention.

FIG. 19 is cross-sectional views illustrating another example of a part of materials configuring flow plates.

The flow plate material 36 for the spherical wave generating diffuser shown in FIG. 19(*a*) has a great number of ridges 36*a* formed in a corrugated manner. The ridges 36*a* may be provided in parallel with the axial direction of the flow plate material 36 or in the direction orthogonal to the axial direction. In cases where the surface of the flow plate material is formed in this way as well, pseudo-spherical waves centered on the flow plate are obtained overall.

The flow plate material 37 shown in FIG. 19(*b*) has a great number of recesses 37*a* and protrusions 37*b* formed on the surface thereof. The recesses 37*a* and protrusions 37*b* may be provided according to some order or may be provided randomly. In cases where the surface of the flow plate material is formed in this way as well, pseudo-spherical waves centered on the flow plate are obtained overall.

The flow plate material 38 shown in FIG. 19(*c*) has a multiple holes 38*a* formed on the surface thereof. The holes 38*a* may be provided according to some order or may be provided randomly, and may be formed as slits extending in parallel with or in the direction orthogonal to the axial direction of the flow plate material 38. Even in cases of forming holes in the flow plate material in this way, pseudo-spherical waves centered on the flow plate are obtained overall.

Note that the present invention is not restricted to the configurations illustrated in the above-described embodiments, and that the number, shape, etc., of the flow plates are not bound to the above embodiments, and the number thereof may be increased, for example. Also, while the drawings have shown examples wherein the cross section of the shape of the flow plates are straight, they may be other shapes such as curves, or irregular shapes. The shape of the horn may also be changed, such as nesting three or more horns, just as long as the sound wave emission speed is faster closer to the center. Also, various modifications may be made to the technical spirit of the present invention, i.e., to the idea of reducing the ratio of the output opening area as to the input opening area the closer to the generally center portion facing the sound emission face. Moreover, it is needless to say that while the attachment method has been illustrated with a configuration of an exemplary embodiment, the present invention is not restricted to the above-described.

The spherical wave generating diffuser according to the present invention can be applied to, in addition to cone type dynamic speakers, plate or dome type dynamic speakers, and speakers using as the sound source thereof flat speakers, such as capacitor speakers or the like.

The invention claimed is:

1. A diffuser for placement in front of a sound wave emission side of a cone-shaped sound source, the diffuser comprising:

a first flow plate positioned along a sound wave emission direction of the sound source, the first flow plate having a wall tapered inwardly in the sound wave emission direction, the wall of the first flow plate being positioned outside of an area defined by the cone-shaped sound source and dimensioned so as to allow sound waves emitted from the cone-shaped sound source to pass on both sides of the wall; and a second flow plate positioned adjacent the first flow plate along the sound wave emission direction, the second flow plate having a wall tapered outwardly in the sound wave emission direction, and the first flow plate being located within an area defined by the wall of the second flow plate.

2. The diffuser as claimed in claim 1, wherein the first flow plate is a tapered cone shape.

3. The diffuser as claimed in claim 1, wherein the first flow plate includes at least two spaced apart plates, inclined towards each other.

4. The diffuser as claimed in claim 1, wherein the second flow plate includes at least two spaced apart plates, inclined away from each.

5. A speaker comprising:

a sound source having a sound wave emission side; and a diffuser according to claim 1 located in front of the sound wave emission side of the sound source.

6. The speaker according to claim 5, further comprising a protective net disposed in front of the sound wave emission side of the sound source, the diffuser being fixed to the protective net.

7. The speaker according to claim 6, wherein the diffuser is fixed in front of the protective net, behind the protective net, or both in front of and behind the protective net.

8. A diffuser for placement in front of a sound wave emission side of a cone-shaped sound source, the diffuser comprising:

a first flow plate positioned along a sound wave emission direction of the sound source, the first flow plate having a first opening proximal to the sound source and a second opening distal from the sound source, the first opening being larger than the second opening, the first opening of the first flow plate being positioned outside of an area defined by the cone-shaped sound source, and the first flow plate being dimensioned so as to allow sound waves emitted from the cone-shaped sound source to pass on both sides of the first flow plate; and a second flow plate positioned adjacent the first flow plate along the sound wave emission direction of the sound source, the second flow plate having a first opening proximal to the sound source and a second opening distal from the sound source, the first opening being larger than the second opening, the first opening of the second flow plate being positioned outside of an area defined by the cone-shaped sound source, and the second flow plate being dimensioned so as to allow sound waves emitted from the cone-shaped sound source to pass on both sides of the second flow plate.

9. The diffuser as claimed in claim 8, wherein the first flow plate is a tapered cone shape.

10. The diffuser as claimed in claim 8, wherein the first flow plate includes at least two spaced apart plates, inclined towards each other.

11. The diffuser as claimed in claim 8, wherein the second flow plate includes at least two spaced apart plates, inclined towards each other.

12. A speaker comprising:

a sound source having a sound wave emission side; and a diffuser according to claim 8 located in front of the sound wave emission side of the sound source.

13. The speaker according to claim 12, further comprising a protective net disposed in front of the sound wave emission side of the sound source, the diffuser being fixed to the protective net.

14. The speaker according to claim 13, wherein the diffuser is fixed in front of the protective net, behind the protective net, or both in front of and behind the protective net.

* * * * *